US008608402B2

(12) United States Patent
Argento et al.

(10) Patent No.: US 8,608,402 B2
(45) Date of Patent: Dec. 17, 2013

(54) LEVELING BLADE, VIBRATING SCREED INCLUDING THE BLADE, AND KIT FOR ASSEMBLING THE SAME

(76) Inventors: Settimio Argento, Montréal (CA); Michele Argento, Montréal (CA)

( * ) Notice: Subject to any disclaimer, the term of this patent is extended or adjusted under 35 U.S.C. 154(b) by 0 days.

(21) Appl. No.: 12/917,218

(22) Filed: Nov. 1, 2010

(65) Prior Publication Data

US 2011/0211910 A1 Sep. 1, 2011

Related U.S. Application Data

(63) Continuation-in-part of application No. 12/873,847, filed on Sep. 1, 2010, now abandoned, which is a continuation of application No. 11/475,986, filed on Jun. 28, 2006, now abandoned.

(60) Provisional application No. 60/694,262, filed on Jun. 28, 2005.

(51) Int. Cl.
*E01C 19/40* (2006.01)

(52) U.S. Cl.
USPC ..... 404/114; 404/118

(58) Field of Classification Search
USPC ..... 404/114, 118
See application file for complete search history.

(56) References Cited

U.S. PATENT DOCUMENTS

| | | | | |
|---|---|---|---|---|
| 2,707,559 | A | | 5/1955 | Saxe |
| 3,067,656 | A | | 11/1962 | Gustafsson |
| 4,340,351 | A | | 7/1982 | Owens |
| 4,343,568 | A | | 8/1982 | Kaltenegger |
| 4,650,366 | A | | 3/1987 | Morrison |
| 4,765,772 | A | | 8/1988 | Benedetti et al. |
| 4,798,494 | A | | 1/1989 | Allen |
| 4,832,525 | A | | 5/1989 | Morrison |
| 4,838,730 | A | | 6/1989 | Owens |
| 4,848,961 | A | | 7/1989 | Rouillard |
| 4,861,188 | A | * | 8/1989 | Rouillard ..... 404/75 |
| 4,944,198 | A | | 7/1990 | Natale et al. |
| 5,375,942 | A | | 12/1994 | Lindley et al. |
| 5,573,344 | A | | 11/1996 | Crane et al. |
| 5,857,803 | A | | 1/1999 | Davis et al. |
| 5,984,571 | A | | 11/1999 | Owens |
| 6,089,787 | A | | 7/2000 | Allen et al. |
| 6,139,217 | A | | 10/2000 | Reuter |
| 6,200,065 | B1 | | 3/2001 | Eitzen |
| 6,223,495 | B1 | | 5/2001 | Shaw et al. |
| 6,231,331 | B1 | | 5/2001 | Lievers |
| 6,267,532 | B1 | | 7/2001 | Persson |
| 6,296,467 | B1 | | 10/2001 | Rouillard |
| 6,322,286 | B1 | | 11/2001 | Rijkers |
| 6,374,569 | B1 | | 4/2002 | Suckow |

(Continued)

*Primary Examiner* — Gary Hartmann
(74) *Attorney, Agent, or Firm* — Merchant & Gould P.C.

(57) ABSTRACT

A leveling blade mounts onto a support bracket of a vibrating screed, and a vibrating screed includes the same. The leveling blade has a substantially vertical portion for mounting onto the support bracket, as well as a substantially slanted portion and a substantially horizontal portion, which results in the leveling blade having a particular profile. The vibrating screed includes also a vibration-generating assembly, being operatively mounted onto the support bracket of the vibrating screed for imparting vibrations to the leveling blade via the support bracket so as to enable carrying out a surfacing of a substantially malleable material with the vibrating screed by passing the leveling blade provided with vibrations about the substantially malleable material. A kit is also provided for assembling such a vibrating screed.

6 Claims, 29 Drawing Sheets

(56) References Cited

U.S. PATENT DOCUMENTS

| | | | | |
|---|---|---|---|---|
| 6,705,799 | B2 | 3/2004 | Piccoli | |
| 6,988,851 | B2 | 1/2006 | Sina | |
| 7,044,681 | B2 | 5/2006 | Quenzi et al. | |
| 7,153,058 | B2 | 12/2006 | Lindley | |
| 7,175,365 | B1 | 2/2007 | Breeding | |
| 7,204,659 | B2 | 4/2007 | Schmitt | |
| 7,572,082 | B2 | 8/2009 | Rouillard | |
| 2005/0069385 | A1 | 3/2005 | Quenzi et al. | |
| 2005/0100407 | A1 | 5/2005 | Sina | |
| 2005/0169707 | A1 | 8/2005 | Lutz | |
| 2006/0133896 | A1 | 6/2006 | Schmitt et al. | |
| 2006/0291958 | A1* | 12/2006 | Argento et al. | 404/118 |
| 2007/0154260 | A1 | 7/2007 | Lindley | |
| 2011/0217121 | A1* | 9/2011 | Argento et al. | 404/118 |

* cited by examiner

LEVELING BLADE, VIBRATING SCREED INCLUDING THE BLADE, AND KIT FOR ASSEMBLING THE SAME

FIELD OF THE INVENTION

The present invention relates to a leveling blade and to a vibrating screed provided with such a blade. More particularly, the present invention relates to a vibrating screed such as the ones used for surfacing concrete, crushed stone and/or other like materials, and also relates to a kit for assembling the same, as well as to a method of use or operation associated thereto. The present application is a Continuation-In-Part (CIP) of U.S. patent application Ser. No. 12/873,847, filed on Sep. 1, 2010, which is a Continuation of U.S. patent application Ser. No. 11/475,986, filed on Jun. 28, 2006 which claims benefit of U.S. provisional patent application No. 60/694,262 dated Jun. 28, 2005, the contents of which applications are incorporated herein by reference.

BACKGROUND OF THE INVENTION

Vibrating screeds are very well known in the art. Indeed, they are generally used for leveling off a horizontal surface such as a floor, typically made of a malleable material, such as concrete and the like, prior to the hardening thereof.

For example, U.S. Pat. No. 7,175,365 B1 granted to BREEDING on Feb. 13, 2007, relates to a portable vibratory concrete screed. The screed includes a screed blade including a flat bottom surface extending between a front edge of the screed blade and a rear edge of the screed blade. The screed also includes a vibrator cartridge assembly, with an eccentric weight, releasably coupled to the screed blade. The blade assembly is capable of receiving many different blade styles. The screed includes a handle assembly extending from both sides of the vibratory assembly. The handle assembly includes adjustable and lockable grips.

U.S. Pat. No. 6,296,467 B1 granted to ROUILLARD on Oct. 2, 2001, relates to a vibrating screed for surfacing concrete. There is described a vibrating screed for surfacing concrete which comprises a surfacing blade, a pair of handle assemblies mounted to said blade, a motor, vibration causing mechanism and a transmission connecting the motor to the vibration causing mechanism such that, when the motor is in operation it causes the transmission to rotate with the transmission being adapted to impart a vibratory motion to the blade. The transmission includes a flexible joint having an angled configuration to allow the motor to be mounted rearwardly of a leading edge of the blade. Each handle assembly comprises a main elongated tubular member and a handle mounted at a proximal end thereof. The handle includes a first tubular element mounted around the main tubular member, a second tubular element extending sideways from the first element and a third tubular element extending around the second element, with a grip member being mounted to the third element. The first element is capable of relative rotatable and translational displacement with respect to the main tubular member, and the third element and grip member are capable of rotational displacement relative to the second element. Clamps are provided for securing the first and third tubular elements in selected positions relative to the main tubular member and to the second tubular element, respectively.

U.S. Pat. No. 6,988,851 B2 granted to SINA on Jan. 24, 2006, relates to a concrete screed with vibration isolation. There is described a vibratory concrete screed which includes a vibration isolation system that minimizes the transmission of vibrations to the operator under normal operating conditions, but becomes more rigid during screed control forces applied to the blade through the isolation system when the operator applies greater forces to the operator handle. The system includes low durometer elastomer vibration isolators isolating the operator handle from the vibration exciter and screed blade in a manner that limits vertical compressive movement of the isolators, yet permits substantially greater horizontal shear movement to effectively isolate the operator from vibration. The isolator mounting arrangement also includes retainers that engage the isolator to limit the amplitude of horizontal shear movement when the operator applies a greater control force to the operator handle.

Also known to the Applicant are the following US patents and patent applications which describe similar and/or other related devices: U.S. Pat. Nos. 2,707,559; 3,067,656; 4,340,351; 4,343,568; 4,650,366; 4,765,772; 4,798,494; 4,832,525; 4,838,730; 4,848,961; 4,944,198; 5,375,942; 5,573,344; 5,857,803; 5,984,571; 6,089,787; 6,139,217; 6,200,065 B1; 6,223,495 B1; 6,231,331 B1; 6,267,532 B1; 6,296,467 B1; 6,322,286 B1; 6,374,569 B1; 6,705,799 B2; 7,044,681 B2; 7,175,365 B1; 7,204,659 B2; 2005/0069385 A1; 2005/0100407 A1; 2005/0169707 A1; 2006/0133896 A1; and 2007/0154260 A1.

Also known to the Applicant are the vibrating screeds described in the following Web site: www.magicscreed.com.

It is also known in the art that a substantial drawback associated with these types of conventional vibrating screeds is that the profile of the blades used is not optimal (very often, they have a "segmented" profile), which results in an undesirable rearwardly accumulation of material behind the blade as it is passed over the material to be leveled. Moreover, very often, the vibratory movement which is transmitted to the blade is also transmitted to the handles of the apparatus, and thus onto the hands of the user, which is undesirable for obvious reasons. Moreover, it can be seen that the handle bars of such a conventional vibrating screed take up a lot of space, which is disadvantageous for storing and/or transportation purposes, and cannot be easily adjusted to allow a more ergonomic use of the vibrating screed for each individual user that may present different physical features or capabilities. Therefore, it would be useful to provide an improved vibrating screed which would have components easily adjustable so as to be better configured for a given user. Moreover, another substantial drawback associated with vibrating screeds of the prior art is that the general design is such that the components thereof may not be easily interchanged in the event of inspection, maintenance and/or repair. Furthermore, another substantial drawback associated with conventional vibrating screeds is that they use gas-operated motor assemblies which need to be operated in well ventilated areas, otherwise they may present health concerns to the users of the vibrating screeds. Moreover, another substantial drawback associated with such conventional vibrating screeds is that the gas-operated motor assemblies are typically very loud when operated, and also represent environmental concerns due to carbon monoxide exhaust. Moreover, conventional vibrating screeds which are operated by gas-operated motor assemblies tend to be heavier because the supply of fuel is directly mounted onto the vibrating screed, thereby making it heavier, which is also undesirable in terms of manoeuvrability, transmission of vibrations to the leveling blade, etc.

Hence, in light of the above-discussed, there is a need for an improved vibrating screed which, by virtue of its design and components, would be able to overcome or at least minimize some of the aforementioned prior art problems and drawbacks.

SUMMARY OF THE INVENTION

The object of the present invention is to provide a leveling blade or a vibrating screed which satisfies some of the above-mentioned needs, and which is thus an improvement over other related leveling blades or vibrating screeds known in the prior art.

In accordance with the present invention, the above object is achieved, as will be easily understood, with a leveling blade or a vibrating screed such as the ones briefly described herein and such as the ones exemplified in the accompanying drawings.

More particularly, according to the present invention, there is provided a vibrating screed for leveling a surface of a substantially malleable material, the vibrating screed comprising:

a substantially L-shaped support bracket having a substantially horizontal portion and a substantially vertical portion;

a substantially L-shaped leveling blade having a leveling portion and a connecting portion, the connecting portion of the leveling blade being removably mountable onto the substantially vertical portion of the support bracket;

a vibration-generating assembly, the vibration-generating assembly being operatively mountable onto the support bracket for imparting vibrations to the leveling blade via the support bracket; and a handling assembly operatively connectable to the support bracket for handling the vibrating screed.

According to yet another aspect of the present invention, there is also provided a method of operating the above-mentioned leveling blade and/or vibrating screed.

According to yet another aspect of the present invention, there is also provided a kit with corresponding components for assembling the above-mentioned vibrating screed.

According to yet another aspect of the present invention, there is also provided a method of assembling components of the above-mentioned kit.

According to yet another aspect of the present invention, there is also provided a surface having been surfaced with the above-mentioned leveling blade and/or vibrating screed.

As will be explained in greater detail hereinbelow, several substantial advantages result from the structural and functional features of the present invention.

For example, the leveling blade has a particular profile so as to overcome various disadvantages associated with the conventional leveling blades of the known vibrating screeds. Namely, and preferably, an outer side of a substantially slanted portion of the leveling blade is at an angle of about 160° with respect to a rear side of its substantially vertical portion.

Preferably also, transitions between adjacent portions of the leveling blade and a second end of the substantially horizontal portion thereof are substantially rounded off, for allowing namely, but not limitedly, a smoother surfacing of a malleable material (concrete, etc.) with the leveling blade, so as to overcome undesirable accumulations and/or streaks known to occur with conventional leveling blades.

As will also be explained in greater detail hereinbelow, the present invention is also advantageous in that it has an innovative handling assembly which is designed to minimize space being occupied by the apparatus when not in use and kept in storage, or for transportation purposes. Indeed, handle bars of the handling assembly are designed so as to enable different folding and tilting configurations, namely by virtue of an innovative tilt adjusting assembly integrated into the handles which do not require the use of any tools, or complicated manoeuvring, thereby enabling a user of the vibrating screed a more ergonomic controlling use of the device, personalized for particular physical capabilities or preferences.

As will also be explained in greater detail hereinbelow, the present invention is also particularly advantageous in that it is provided with a set of vibration-damping joints used for operatively connecting the extremities of the handle bars of the handling assembly to the support bracket of the vibrating screed, in order to minimize vibration transmission therein between, once again, for an easier and much smoother operation of the vibrating screed.

Another substantial improvement of the present invention over the prior art is that the motor assembly includes an electric motor for imparting vibrations to the leveling blade via the support bracket, the electric motor being operatively mountable onto the support bracket, but being powered by a power supply located separate from the vibrating screed, such power supply being preferably a portable power assembly which is removably mountable onto a user of a vibrating screed, and which may come in a form of a rechargeable battery for example, storable inside a backpack, a working belt, or any other suitable garment to be used by an operator of the vibrating screed. Due to this particular design, the vibrating screed according to the present invention is a much lighter device, for easier manoeuvrability, given that the power supply and corresponding weight associated thereto is removed from the vibrating screed, and also allows for an easier interchangeability of power supplies, whenever they are depleted, given that they are easily and conveniently connected via electric wiring to corresponding electric wiring of the vibrating screed by means of a quick and easy connection, such as a plug, for example.

The objects, advantages and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
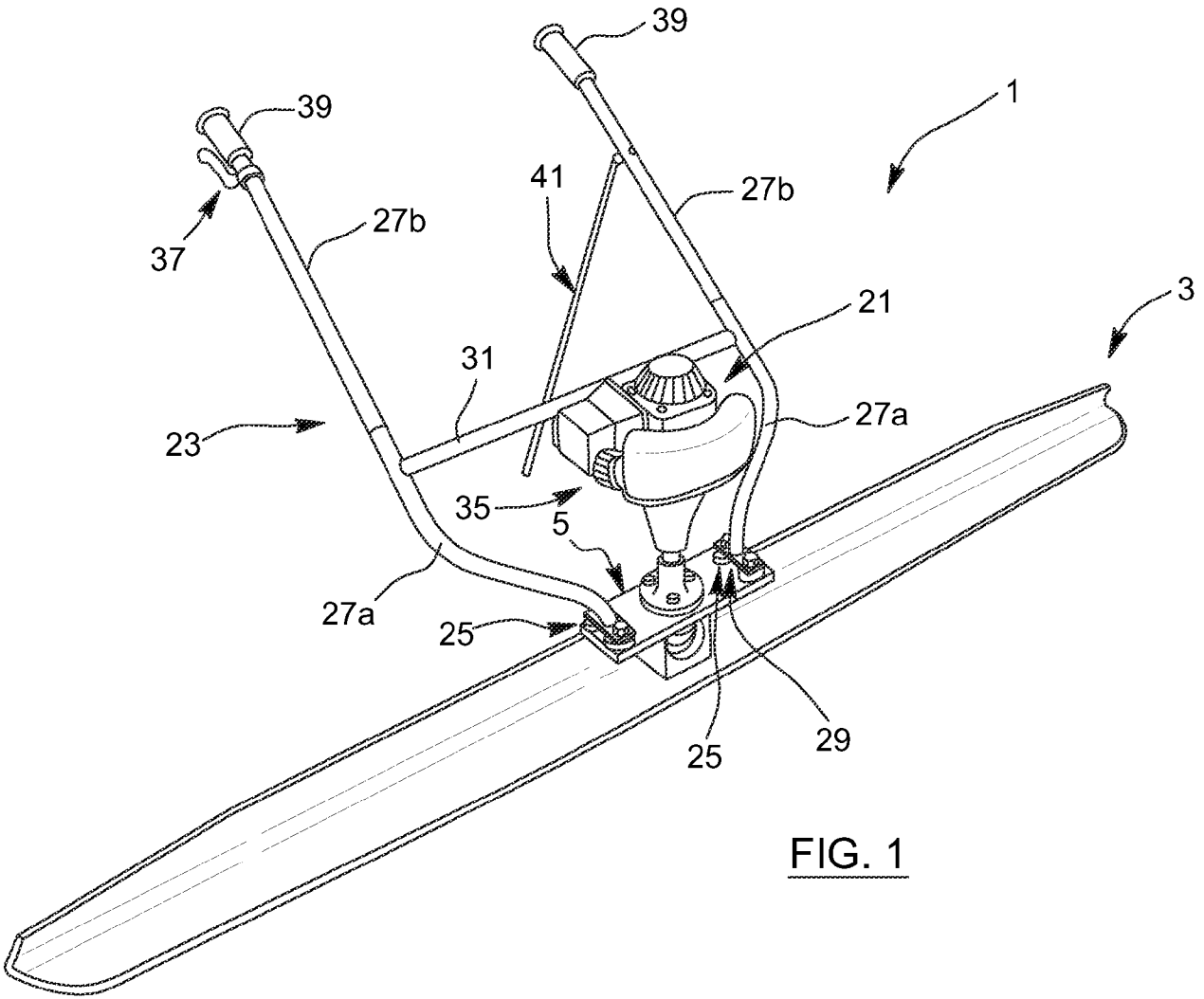
FIG. 1 is a front perspective view of a vibrating screed according to a preferred embodiment of the present invention, the vibrating screed being shown with at least one handle bar thereof being provided with a support leg for supporting the vibrating screed when not employed by a user, as illustrated.

In the following description, the same numerical references refer to similar elements. The embodiments, geometric configurations and dimensions shown in the figures and/or presented herein, are preferred and for exemplification purposes only.

Moreover, although the present invention was primarily designed for leveling surface of concrete and the like, typically prior to hardening thereof, it may be used with other types of screeds and objects, and in other fields, as apparent to a person skilled in the art. For example, the present vibrating screed can also be used to level crushed stone (screening), for those installing paving stones. For this reason, expressions such as "concrete", "leveling", "surfacing", "floor", "vibrating", "hardening", "stone", etc. used herein should not be taken as to limit the scope of the present invention and includes all other kinds of screeds, blades or items, and all other purposes, with which the present invention could be used and may be useful.

Moreover, in the context of the present invention, the expressions "screed", "blade", "device", "unit", "assembly", "product", and any other equivalent expression and/or compound word thereof (e.g. "vibrating screed") known in the art will be used interchangeably. Furthermore, the same applies for any other mutually equivalent expressions, such as "surfacing" and "leveling", "rivets", "bolts", "nuts" and "fasteners", "vibrations", "vibratory movement" and "pulses", as well as "metal" and "steel" for example, as also apparent to a person skilled in the art. The same can be said for other mutually equivalent expressions, such as "clamp" and "clip", "section" and "arm", "opening", "hole" and "bore", "secured", "pressed", "tightened", "locked" and "maintained" for example, as also apparent to a person skilled in the art.

Furthermore, in the context of the present description, it will be considered that all elongated objects will have an implicit longitudinal axis, and that expressions such as "connected" and "connectable", or "mounted" and "mountable", may be interchangeable, in that the present invention also relates to a kit with corresponding components for assembling a resulting fully assembled vibrating screed.

In addition, although the preferred embodiments of the present invention as illustrated in the accompanying drawings comprise various components and although the preferred embodiments of the leveling blade and corresponding vibrating screed as shown consist of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the vibrating screed and corresponding parts according to the present invention, as briefly explained and inferred herein, without departing from the scope of the invention.

List of numerical references for some of the corresponding preferred components illustrated in the accompanying drawings:

1. vibrating screed
3. leveling blade
3*a*. leveling portion
3*b*. connecting portion
3*c*. uppermost edge
5. support bracket
7. substantially vertical portion (of leveling blade 3)
7*a*. front side
7*b*. rear side
7*c*. first end
7*d*. second end
9. substantially slanted portion (of leveling blade 3)
9*a*. inner side
9*b*. outer side
9*c*. first end
9*d*. second end
11. substantially horizontal portion (of leveling blade 3)
11*a*. top side
11*b*. bottom side
11*c*. first end
11*d*. second end
13. outer corner (of substantially slanted portion 9)
15. inner corner (of substantially slanted portion 9)
17. bottom corner (of substantially horizontal portion 11)
19. upper corner (of substantially horizontal portion 11)
21. vibration-generating assembly
23. handling assembly
25. vibration-damping joint
27. handle bar
27*a*. first section
27*b*. second section
27*c*. third section
29. connecting plate
31. cross-bar
31*a*. first cross-bar
31*b*. second cross-bar
33. recessed segment (of cross-bar 31)
35. control system
37. actuator
39. handle
41. support leg (or "stand")
41*a*. first extremity
41*b*. second extremity
43. shaft assembly (or simply "shaft")
45. cam
47. substantially horizontal portion (of support bracket 5)
47*a*. top side
47*b*. bottom side
49. substantially vertical portion (of support bracket 5)
49*a*. front side
49*b*. rear side
51. orifice (of support bracket 5) (or simply "through-hole")
53. bore (of cam 45)
55. hole (of cam 45)
56. fastener (of cam 45)
57. support bearing
59. hole (of support bearing 57)
61. flange (of support bearing 57)
63. casing
65. hole (of casing 63)
67. lower end (of handle bar 27)
69. fastener
69*a*. T-shaped fastener
69*b*. complementary fastener (ex. nut) for T-shaped fastener
71. inner bore (of vibration-damping joint 21)
73. extremity (of fastener 69)
75. straight section (of first section 27*a* of handle bar 27)
77. inwardly-slanted section (of first section 27*a* of handle bar 27)
79. clamp mechanism
81. distal open end (of first section 27*a* of handle bar 27)
83. supporting flange (of clamp mechanism 79)
85. retaining mechanism
87. tilt-adjustment assembly
89. sleeve
91. distal end (of second section 27*b* of handle bar 27)
93. slit (of sleeve 89)
95. pivot barrel
97. threaded socket (of pivot barrel 95)
99. screw component
101. shouldering flange
103. locking washer
103*a*. front face
103*b*. rear face
103*c*. inner bore
105. motor assembly
107. flexible engine shaft
107*a*. first end
107*b*. second end
107*c*. interconnecting portion
109. notch
109*a*. notch (of first end 107*a* of flexible engine shaft 107)
109*b*. notch (of second end 107*b* of flexible engine shaft 107)
111. integrated longitudinal shoulder (of support bracket 5)
113. holes
113*a*. hole (on support bracket 5)
113*b*. hole (on leveling blade 3)
115. bottom cover (of casing 63)
117. bottom opening (of casing 63)
119. drive shaft
119*a*. first extremity (of drive shaft 119)
119*b*. second extremity (of drive shaft 119)
121. shaft housing
123. electric motor
125. power supply
127. rechargeable battery
129. backpack
131. working belt

133. electric wiring
133*a*. electric wiring (of rechargeable battery 127)
133*b*. electric wiring of (vibrating screed 1)
135. electric connection (ex. plug)
137. control box
139. connector Broadly described, the vibrating screed (1) according to the present invention, as shown in the accompanying drawings, is a screed device for leveling surfaces made of a malleable material, such as concrete, crushed stones and/or the like, so as to ensure a fairly smooth surface, in applications well known in the art (construction, renovation, etc.). As can be easily understood by a person skilled in the art from the accompanying figure, a leveling blade (3) is passed over the surface to be leveled off, a motor assembly (105) being used for transmitting a vibratory movement to the leveling blade (37), and the apparatus being provided with suitable handle bars (27) in order to operate the screed (1), with control means used for controlling the extent of vibratory movement to be transmitted from the motor assembly (105) to the leveling blade (3).

The vibrating screed (1) according to the present invention is particularly advantageous in that it comprises a leveling blade (3) having a particular profile, enabling to overcome some of the disadvantages associated with leveling blades known in the prior art. Indeed, as better shown in FIGS. 2-5, and according to a preferred embodiment of the present invention, the leveling blade (3) is used for mounting onto a support bracket (5) of a vibrating screed (1), and preferably comprises a substantially vertical portion (7), a substantially slanted portion (9), and a substantially horizontal portion (11). As better shown in FIGS. 2 and 5, the substantially vertical portion (7) is preferably used for removably mounting onto the support bracket (5) of the vibrating screed (1), and preferably also has front and rear sides (7*a*,7*b*), as well as first and second ends (7*c*,7*d*). Preferably also, the substantially slanted portion (9) extends rearwardly from the second end (7*d*) of the substantially vertical portion (7), and has inner and outer sides (9*a*,9*b*), as well as first and second ends (9*c*,9*d*). Preferably also, the substantially horizontal portion (11) extends frontwardly from the second end (9*d*) of the substantially slanted portion (9), and has top and bottom sides (11*a*,11*b*), as well as first and second ends (11*c*,11*d*).

Figure 2:
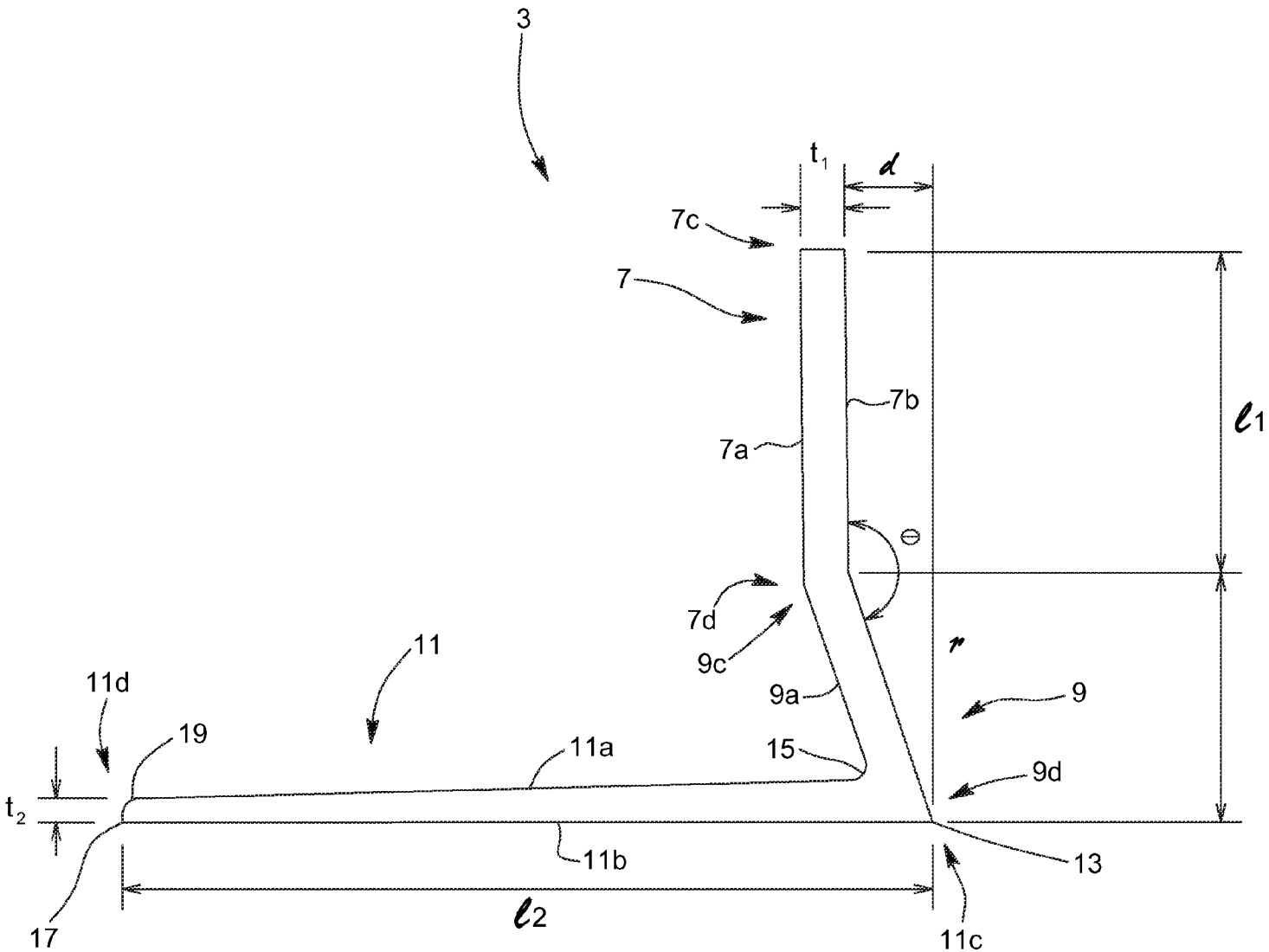
FIG. 2 is a side elevational view of a leveling blade according to the preferred embodiment of the present invention.

As can be easily understood when referring to FIG. 2, it is worth mentioning that the second end (7*d*) of the substantially vertical portion (7) corresponds essentially to the first end (9*c*) of the substantially slanted portion (9), and that the second end (9*d*) of the substantially slanted portion (9) corresponds essentially to the first end (11*c*) of the substantially horizontal portion (11). Preferably also, transitions between adjacent portions (7,9,11) of the leveling blade (3) and the second end (11*d*) of the substantially horizontal portion (11) thereof are substantially rounded off, as previously explained and as also better shown in FIG. 2.

As discussed above, and according to the preferred embodiment of the present invention, the leveling blade (3) has a particular profile which enables it to obtain improved performances when compared to what is possible with leveling blades known in the prior art. More particularly, and preferably, as also better shown in FIG. 2, the outer side (9*b*) of the substantially slanted portion (9) is at an angle θ of about 160 degrees with respect to the rear side (7*b*) of the substantially vertical portion (7). Preferably also, the ratio between the length of the rear side (7*b*) of the substantially vertical portion (7) and the length of the bottom side (11*b*) of the substantially horizontal portion (11) is about 0.4, whereas the ratio between the length of the rear side (7*b*) of the substantially vertical portion (7) and the length of the substantially slanted portion (9) is about 1.26, and preferably as well, the top side (11*a*) of the substantially horizontal portion (11) tapers off frontwardly with respect to the bottom side (11*b*) thereof at an angle of about two (2) degrees, as can be easily understood when referring to FIG. 2. According to yet a more preferred embodiment of the present invention, the wall thickness ($t_1$) of the substantially vertical portion (7) is about 0.250 inches, whereas the horizontal distance (d) between the outer side (7*b*) of the substantially vertical portion (7) and an outer corner (13) of the substantially slanted portion (9) is about 0.500 inches. As also better shown in FIG. 2, the vertical rise (r) of said substantially slanted portion (9) is about 1.500 inches, and the length ($l_1$) of the outer side (7*b*) of the substantially vertical portion (7) is about 2.000 inches, while the bottom side (11*b*) of the substantially horizontal portion (11) preferably has a length ($l_2$) of about 5.000 inches. Preferably also, the aforementioned outer corner (13) of the substantially slanted portion (9) has a ratio of curvature of about 0.031, whereas an inner corner (15) of said substantially slanted portion (9) has a ratio of curvature of about 0.062. According to this particular and preferred embodiment of the leveling blade (3), the second end (11*d*) of the substantially horizontal portion (11) would have a thickness ($t_2$) of about 0.125 inches, and a bottom corner (17) thereof would have a ratio of curvature of about 0.015, whereas an upper corner (17) thereof would have a ratio of curvature of about 0.125.

It is of course to be understood that these particular dimensions and geometrical configurations are given as way of an example only, so as to illustrate what a preferred profile of the leveling blade (3) according to the present invention would look like, but it is also to be understood that several other modifications could be made thereto, while carrying out essentially the same functions and obtaining substantially the same resulting advantages, and without departing from the scope of the present invention, as apparent to a person skilled in the art.

According to the present invention, there is also provided a vibrating screed (1) for leveling or surfacing a surface of a substantially malleable material, such as concrete and the like, and the vibrating screed (1) preferably comprises a support bracket (5), a leveling blade (3) such as the aforementioned or other, being mounted on the support bracket (5), and a vibrating-generating assembly (21), the vibrating-generating assembly (21) being operatively mounted onto the support bracket (5) for imparting vibrations to the leveling blade (3) via the support bracket (5), as can be easily understood when referring to FIGS. 1-5 and 9.

Preferably also, and as better shown in FIGS. 1, 3, 5, 10 and 11, the vibrating screed (1) further comprises a handling assembly (23), operatively connected to the support bracket (5) via at least one vibration-damping joint (25), for handling the vibrating screed (1). Even more preferably, the handling assembly (23) comprises a pair of handle bars (27), each handle bar (27) having an end operatively connected to the support bracket (5) via at least one vibration-damping joint (25), as better shown and as can be easily understood from FIGS. 3-5. Preferably also, the ends of the handle bars (27) are each connected to a corresponding connecting plate (29), each connecting plate (29) being operatively connected to the support bracket (5) via at least one vibration-damping joint (25), as better shown in FIGS. 3 and 5. Preferably also, and as better shown in FIG. 5, each vibration-damping joint (25) comprises a sleeve made of an elastic material, and having an inner bore, each vibration-damping joint (25) being connected between a given connecting plate (29) and the support bracket (5) via a corresponding fastener extending through said inner bore of the vibration-damping joint (25) and having extremities in abutment with outer portions of the given connecting plate (29) and the support bracket (5). It is worth mentioning that several different types of fasteners could be used in order to achieve the above-mentioned end result and advantages, a bolt assembly with a conventional bolt and corresponding nut being illustrated in the embodiment of FIG. 5, as way of example. Obviously, other suitable fasteners may be used without departing from the scope of the present invention, as apparent to a person skilled in the art.

Figure 5:
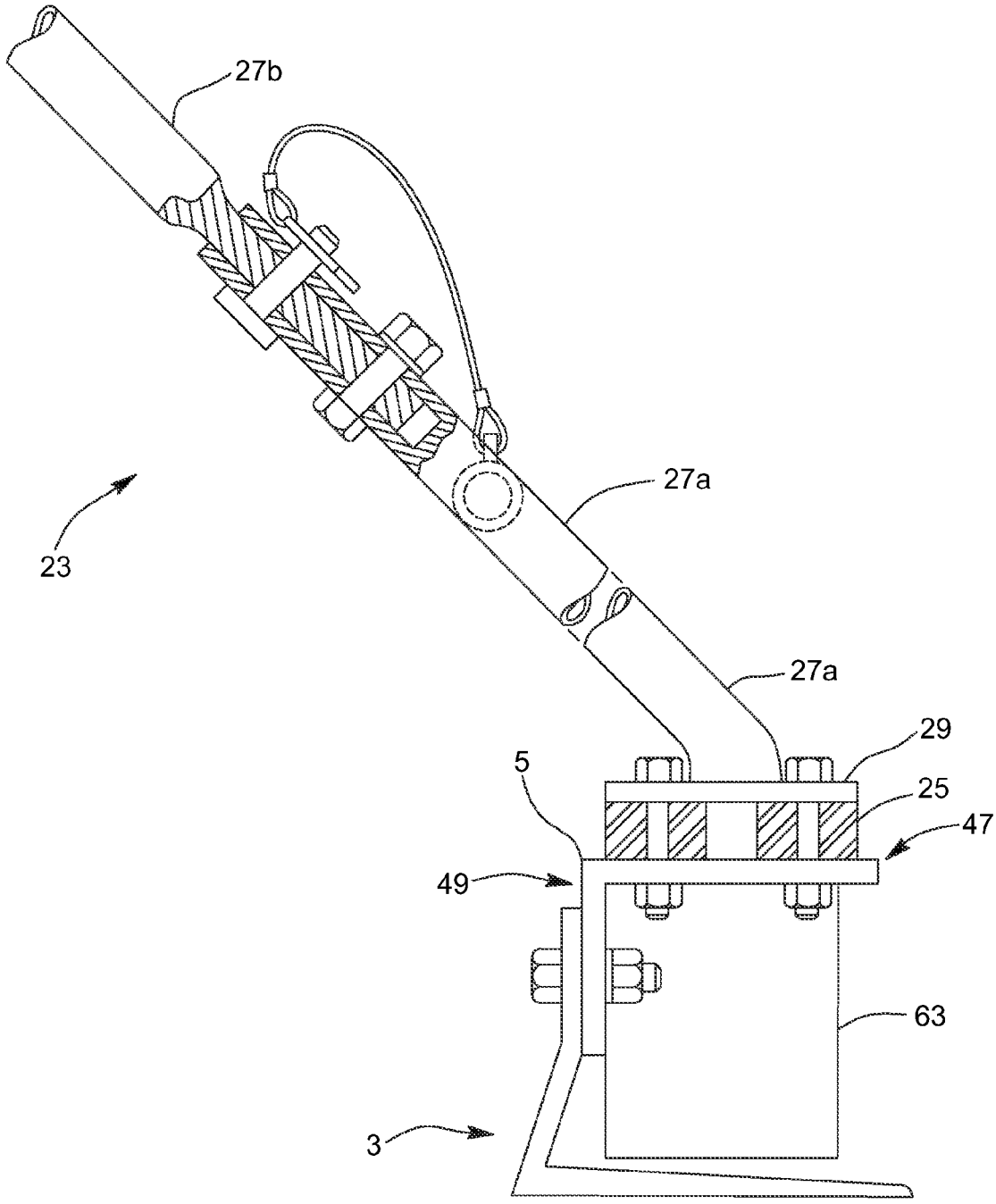
FIG. 5 is a partial side view of some components of a vibrating screed according to another preferred embodiment of the present invention, some of the components thereof being shown in a sectional view.

Furthermore, and according to a preferred embodiment of the present invention, each connecting plate (29) is substantially rectangular and is preferably operatively connected to the support bracket (5) via a pair of vibration-damping joints (25) being mounted respectively to corresponding opposite ends of each substantially rectangular connecting plate (29), as better shown in FIGS. 1 and 5.

It is worth mentioning also that instead of having a single connecting plate (29) for a given end of a handle bar (27), other configurations could be employed for the present invention, namely by providing a unique and transversely elongated connecting plate (29) onto which both ends of the handle bars (27) would be appropriately connected, said unique connecting plate (29) being then appropriately mounted onto the support bracket (5) of the vibrating screed (1) via a suitable number of vibration-damping joints (25), as can be easily understood by a person skilled in the art.

Figure 3:
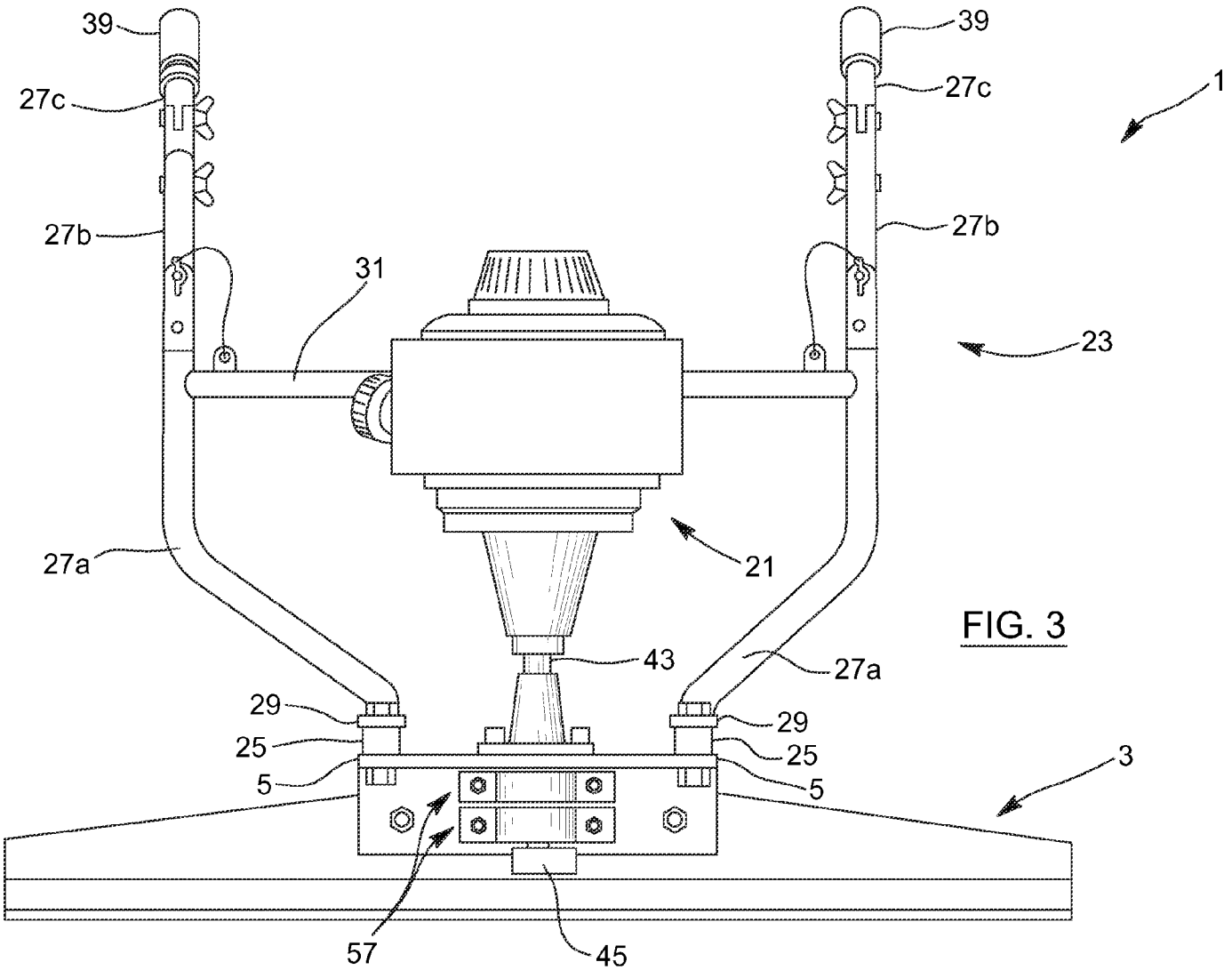
FIG. 3 is a front plan view of a vibrating screed according to another preferred embodiment of the present invention, the vibrating screed being shown with its handle bars in an operative configuration.
Figure 4:
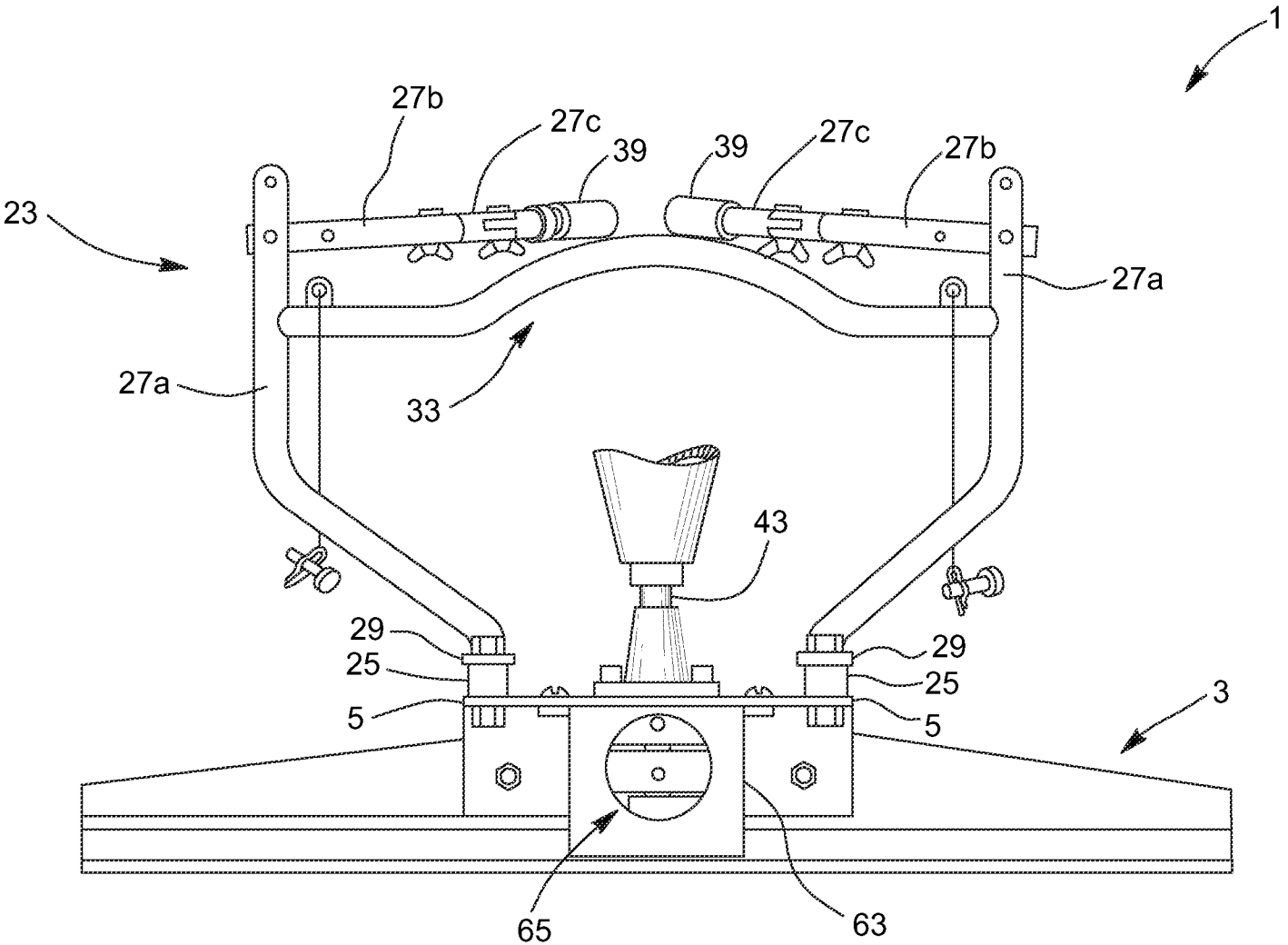
FIG. 4 is another front plan view of what is shown in FIG. 3, the handle bars of the vibrating screed being now shown in a retracted configuration, and the vibration-generating assembly being removed so as to better illustrate a recessed portion of a cross-bar according to a preferred embodiment of the present invention, the vibrating screed being also shown with a casing encasing support bearings of the vibrating screed.

Preferably also, and according to another preferred aspect of the present invention, each handle bar (27) comprises first and second sections (27*a*,27*b*) operatively connected to one another, the second section (27*b*) being adjustably pivotable with respect to the first section (27*a*), as can be easily understood when comparing FIGS. 3 and 4. Preferably also, and as better shown in FIGS. 1 and 4, the handling assembly (23) comprises a cross-bar (31) extending between the first sections (27*a*) of the handle bars (27), and preferably also, the cross-bar (31) comprises a recessed segment (33) in a substantially middle portion of said cross-bar (31), as better shown in FIG. 4, so as to facilitate a grasping and handling of the vibrating screed (1), when not in use, for example.

According to one preferred aspect of the present invention, the second section (27*b*) of each handle bar (27) may be adjustably pivotable with respect to the first section (27*a*) thereof along a substantially vertical plane, so as to for example, adjust the degree of tilt of the second section (27*b*) of a given handle bar (27) with respect to the ground surface onto which the vibrating screed (1) is to be displaced, and thereby enabling for a more ergonomic handling and use of an operator. However, and according to another preferred aspect of the present invention, the vibrating screed 1 may be provided with suitable means so that the second section (27*b*) of each handle bar (27) may be adjustably pivotable with respect to the first section (27*a*) thereof and against the cross-bar (31), as can be better understood when referring to FIGS. 3 and 4, so as to minimize the space taken up by the handling assembly (23) (i.e. handle bars (27), etc.) when the vibrating screed (1) is not in use, and thereby minimizing space taken up by the vibrating screed (1) when not in use, which is advantageous for storing purposes.

Figure 10:
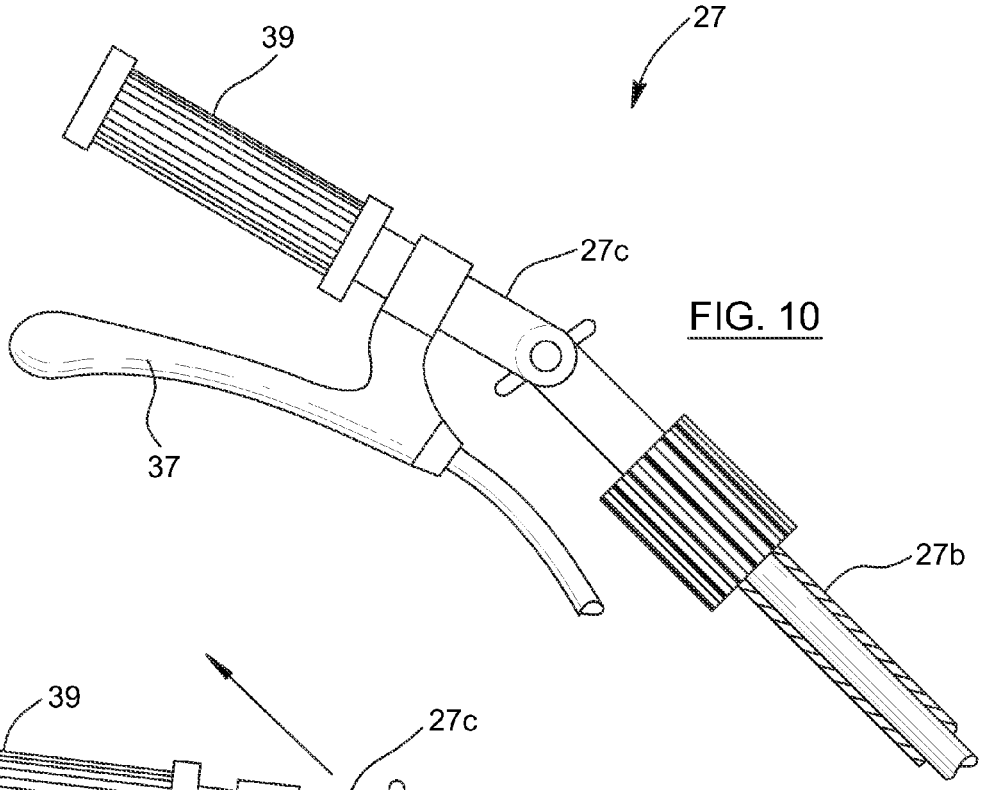
FIG. 10 is a partial view of an extremity of a handle bar according to a preferred embodiment of the present invention, said extremity being shown with a third section of the handle bar in a first configuration.
Figure 11:
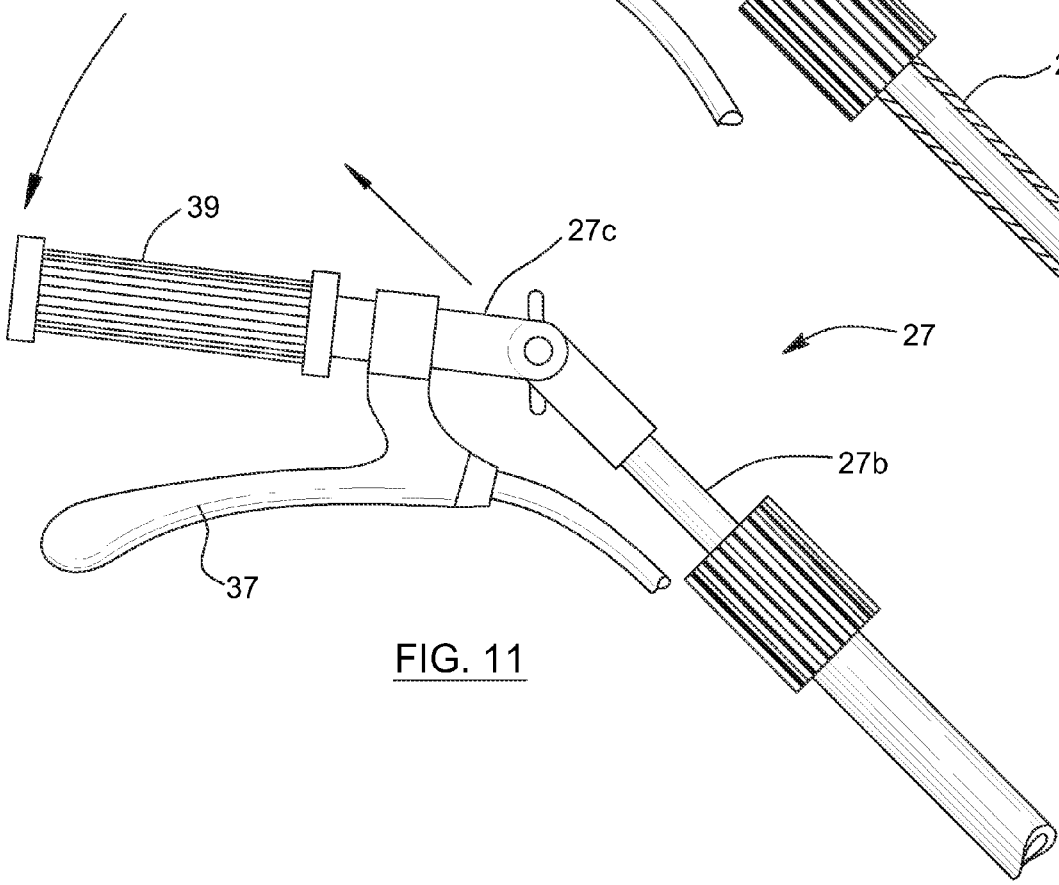
FIG. 11 is another view of what is shown in FIG. 10, the extremity being shown now with the third section of the handle bar in another adjusted configuration.
Figure 12:
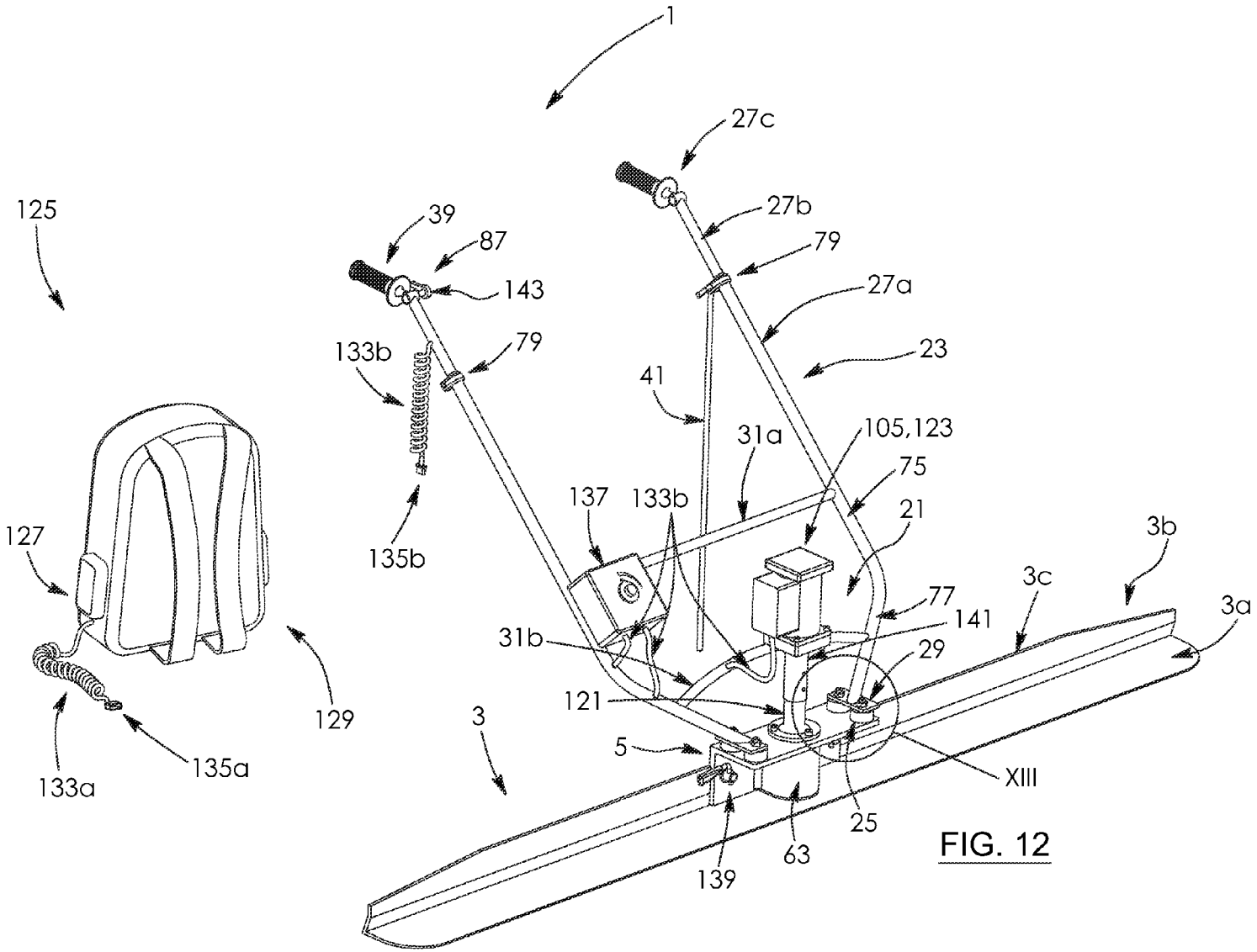
FIG. 12 is a perspective view of a vibrating screed provided with a portable power supply separate from the vibrating screed according to a preferred embodiment of the present invention.

Preferably also, each handle bar (27) could be provided with a third section (27*c*), as can be easily understood when referring to FIGS. 10 and 11, which would be operatively connected to the second section (27*b*) of a given handle bar (27), the third section (27*c*) being adjustably pivotable with respect to the second section (27*b*) along a substantially vertical plane, so that said third section (27*c*) of the handle bar (27) could be adjustably tilted with respect to the second section (27*b*), or indirectly, with respect to the ground surface onto which the vibrating screed (1) is to be operated on, thereby enabling for any easier and more ergonomic use for a given operator of the vibrating screed (1), depending on the physical features or capabilities thereof. The vibrating screed (1) according to the present invention is preferably provided with an innovative tilt adjustment assembly (87) cooperable with each handle (39), which will be explained in greater detail hereinbelow.

Preferably also, and as can be easily understood when referring to FIGS. 1, 10 and 11, the vibrating screed 1 preferably comprises a control system (35) for controlling an extent of vibrations being generated by the vibration-generating assembly (21), and said control system (35) can be conveniently mounted onto a corresponding component of the vibrating screed (1), namely on or adjacent to a motor driving the same, and being preferably linked to a corresponding extremity of the handle bar (27), and preferably also, to a third section (27*c*) thereof, said third section (27*c*) being preferably provided with a corresponding actuator (37) so as to remotely be able to control the control system (35) by a simple operation of the actuator (37) being positioned conveniently adjacent to the handle (39) of the extremity of the handle bar (27), as better shown in FIGS. 10 and 11.

According to another preferred aspect of the present invention, at least one handle bar (27) or other suitable component of the vibrating screed (1) could be provided with a corresponding support leg (41) for supporting the vibrating screed (1) when not in use, that is, for enabling the vibrating screed (1) to be balanced or kept in a substantially upright configuration as a result of the support leg (41) appropriately acting as a support between said corresponding at least one handle bar (27) and a ground surface, for example. In such a preferred embodiment, an extremity of the support leg would be provided with a corresponding joint being removably insertable into a corresponding component of said at least one given handle bar (27), and a corresponding section (27*a*,27*b*,27*c*) thereof, as can be easily understood by a person skilled in the art.

Referring now to FIGS. 1-4 and 9, one can easily understood that according to a preferred embodiment of the present invention, the vibration-generating assembly (21) comprises a motor cooperating with a shaft (43), the shaft (43) being drivable by the motor and having an extremity provided with an eccentric cam (45) so as to impart vibrations to the system, and ultimately, to the leveling blade (3), when rotatably driven by the motor. As previously mentioned, the vibrating screed preferably comprises a control system (35) for controlling an extent of vibrations being generated by the vibration-generating assembly (21), and said control system (35) could be controlled directly or remotely, via a suitable linkage, for example, with corresponding actuator (37) being preferably provided on a corresponding handle (39) of a handle bar (27), as previously explained, or ultimately, could be remotely controlled via other suitable means, such as with a remote control for example, as can be easily understood by a person skilled in the art.

Figure 6:
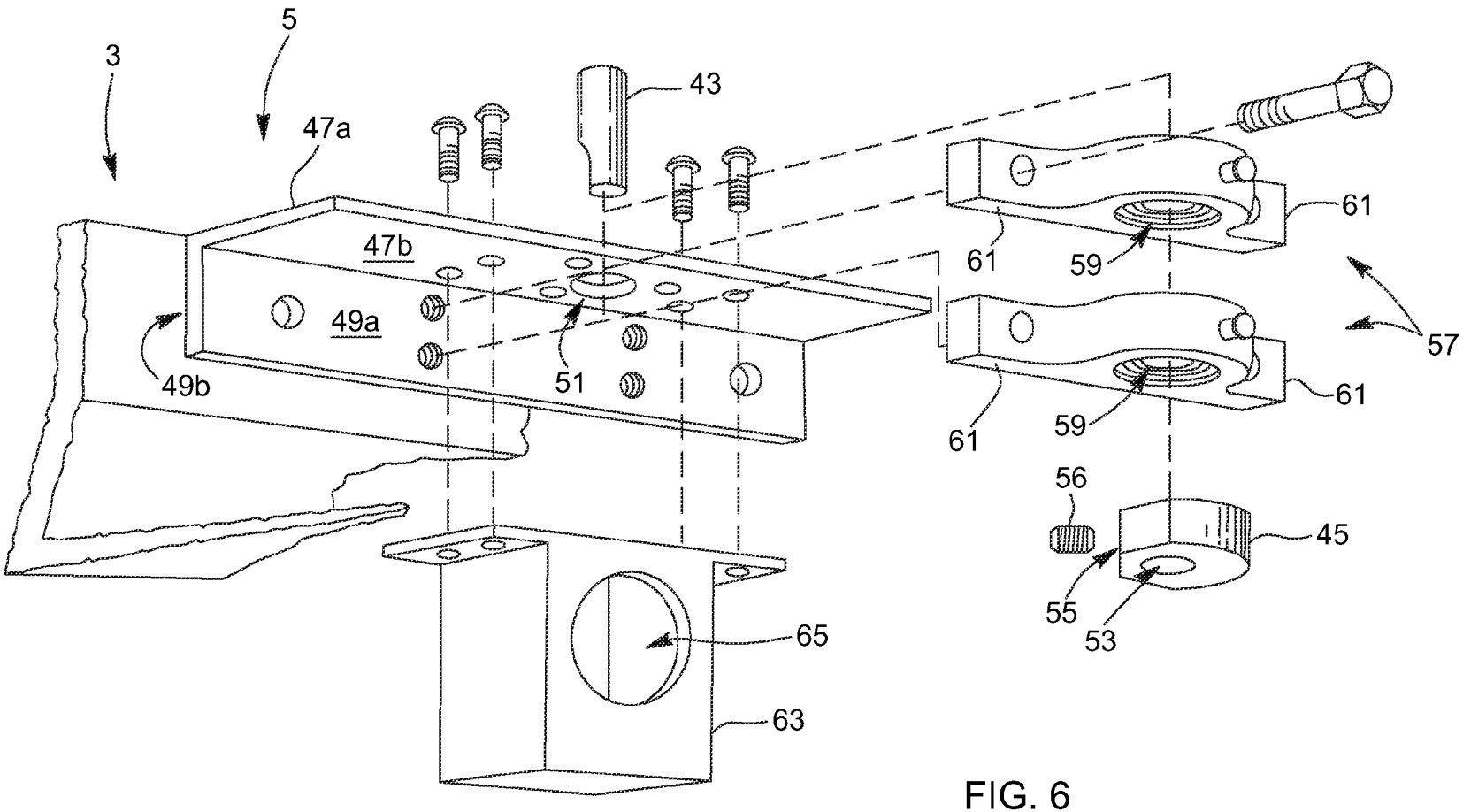
FIG. 6 is an exploded view of other components of the vibrating screed according to another preferred embodiment of the present invention, said exploded view better illustrating the support bracket, support bearings, casing and eccentric cam of the vibrating screed according to this particular preferred embodiment.
Figure 7:
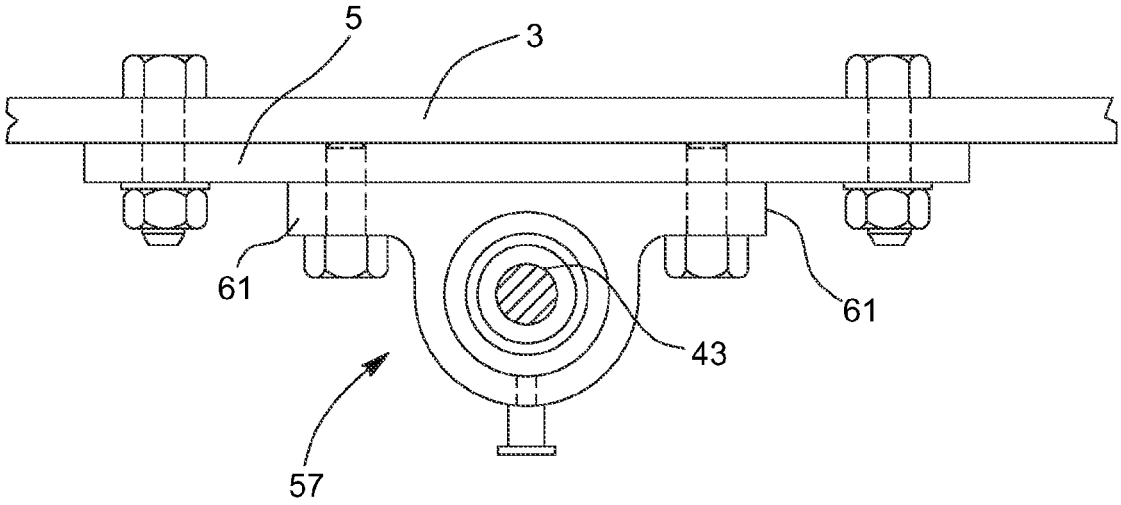
FIG. 7 is a top view of a support bearing mounted onto a support bracket of a vibrating screed according to a preferred embodiment of the present invention.
Figure 8:
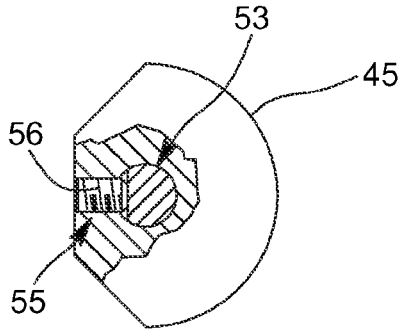
FIG. 8 is a bottom view of an eccentric cam mounted onto a shaft of a vibration-generating assembly according to a preferred embodiment of the present invention, said shaft and the fastener used for securing the eccentric shaft thereon, as well as a portion of the cam, being shown in a sectional view.

Referring now to FIGS. 5 and 6, there is shown how the preferred embodiment of the support bracket (5) of the vibrating screed (1) according to the present invention is preferably substantially L-shaped, having a substantially horizontal portion (47) with top and bottom sides (47*a*,47*b*), and a substantially vertical portion (49) with front and rear sides (49*a*,49*b*), the front side (7*a*) of the substantially vertical portion (7) of the leveling blade (3) being removably connectable onto the rear side (49*b*) of the substantially vertical portion (49) of the support bracket (5) via suitable fasteners, such as bolts and the like, or other suitable means, cooperating with corresponding holes or components provided on the leveling blade (3) and support bracket (5) respectively, as apparent to a person skilled in the art.

Figure 9:
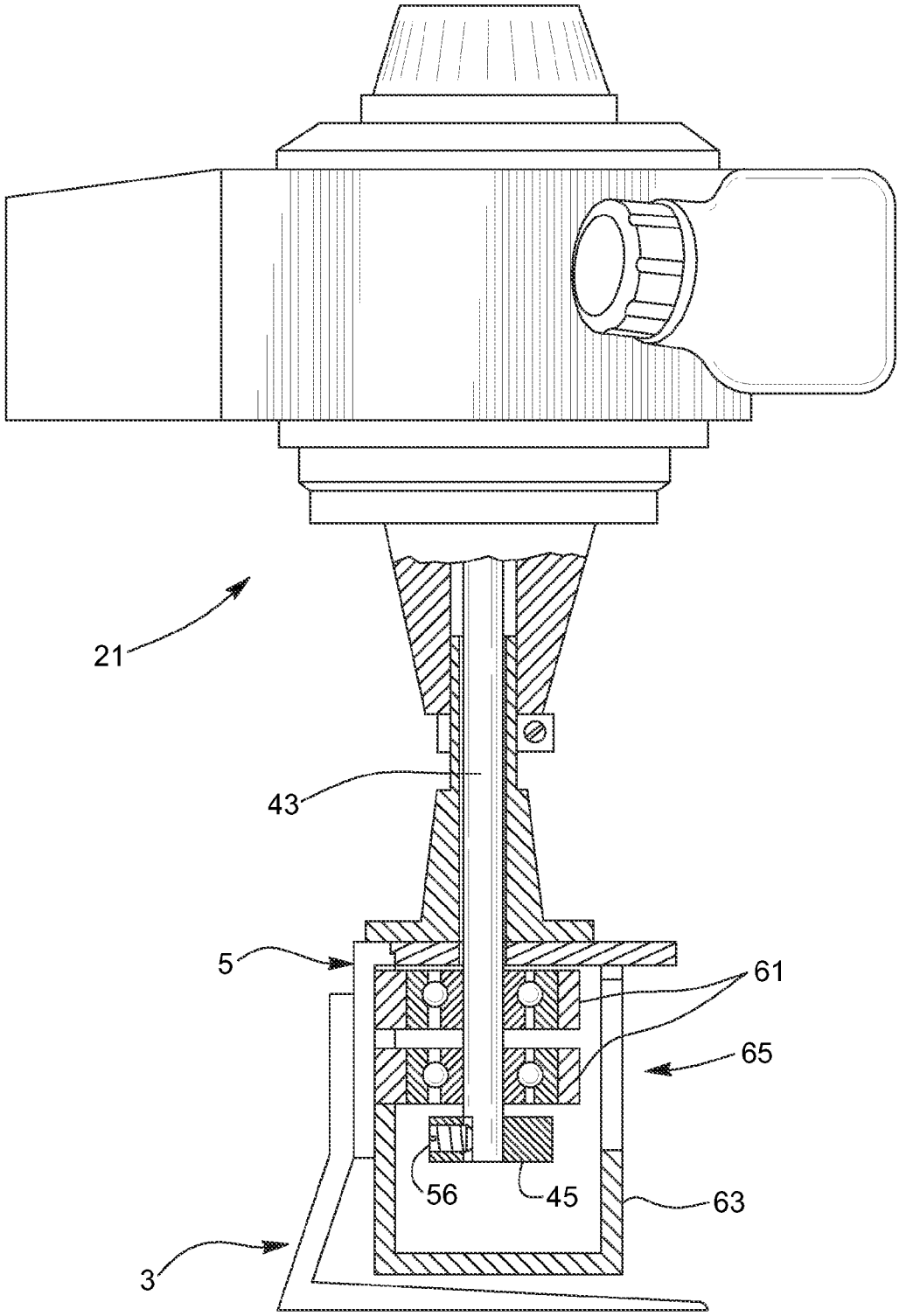
FIG. 9 is a side view of a vibration-generating assembly cooperating with a support bracket according to yet another preferred embodiment of the present invention, some of the components illustrated being shown in a sectional view.

According to one alternative aspect of the present invention, and as better shown in FIG. 9, the shaft (43) of the vibrating-generating assembly (21) may consist of a one-piece shaft (43), also referred to here as a "monoshaft" (43), and preferably also, the substantially horizontal portion (47) of the support bracket (5) is provided with a corresponding orifice (51) through which the shaft (43) of the vibration-generating assembly (21) extends, as better illustrated in FIG. 6. However, instead of having a substantially unitary and/or rigid "monoshaft" (43) as is the case with conventional vibrating screeds, a substantial improvement of the present vibrating screed (1) resides in the use of a flexible engine shaft (107), as will be explained in greater detail hereinbelow.

Furthermore, in order to be able to generate vibrations or pulses, and to transmit them to the vibrating screed (1), and more particularly to the leveling blade (3) thereof, so as to be able to carry out a proper leveling or surfacing of a malleable material with the leveling blade (3) being imparted such vibrations, this is preferably carried out by having an eccentric cam (45) being removably mountable onto the extremity of the shaft (43), as better shown in FIGS. 3, 6, 8 and 9. Preferably also, and so as to facilitate the interchangeability and ease of repair and maintenance of the components, the eccentric cam (45) preferably comprises a bore (53) for removably inserting the cam (45) into the extremity of the shaft (43) and a transversal hole (55) for receiving a corresponding fastener (56) for removably securing the cam (45) onto said shaft (43), as can be easily understood when referring to FIGS. 8 and 9. Preferably also, and in continuing with a desire to facilitate interchangeability of components, and facilitate an inspection, a maintenance and/or a repair thereof, the vibrating screed (1) also comprises at least one support bearing (57) for supporting a portion of a shaft (43) of the vibration-generating assembly (21), beneath the substantially horizontal portion (47) of the support bracket (5), each support bearing (57) having a corresponding hole (59) through which the shaft (43) extends, and being removably connectable to a given side of the support bracket (5), as better shown in FIG. 3, and as can be easily understood from FIG. 6. Preferably also, this is conveniently carried out in that each support bearing (57) is preferably provided with a pair of flanges (61) removably mounted onto the given side of the support bracket (5) by means of corresponding fasteners, such as bolts and the like, as well as other corresponding means, as apparent to a person skilled in the art.

As can also be easily understood from FIG. 9, each support bearing (57) may comprise a one-piece component where a recess is defined therein for inserting the corresponding bearing and said piece being integrally provided with the above-mentioned corresponding flanges (61).

Preferably also, the vibrating screed (1) according to a preferred embodiment of the present invention comprises a casing (63) being removably mounted to the given side of the support bracket (5) and being shaped and sized for encasing each support bearing (57) so as to protect the same, as can also be easily understood when referring to FIG. 9. The casing (63) may be provided with a hole (65) on the front portion of said casing (63), so as to namely, be able to visualize the inner content thereof, and more particularly be able to visualize the support bearings (57) encased within said casing (63), as better shown in FIG. 4. However, according to a particular innovative aspect of the present invention, the casing (63) used for the present vibrating screed (1) is an integrated casing being part of the support bracket, as will be explained in greater detail hereinbelow.

Indeed, as better shown in the accompanying drawings, the vibrating screed (1) comprises a main mounting bracket (i.e. "support" bracket (5)), which is preferably L-shaped. Preferably also, the leveling blade (3) to be used for leveling off a surface is removably connectable onto the substantially vertical portion (49) of the support bracket (5) by means of suitable fasteners, such as screws, bolts, rivets, washers, and the like, and the substantially horizontal portion (47) of the support bracket (5) is destined to transmit a vibratory movement from the motor to the leveling blade (1), and also destined for receiving handle bars (27) in order to handle, guide and operate the vibrating screed (1). As better shown in FIGS. 3, 4, 6 and 9, and as can be easily understood therefrom, a shaft (43) of the motor passes through a corresponding orifice (51) of the second flange of the support bracket (5), said shaft (43) being preferably provided with a cam (45) mounted eccentrically at the end thereof, said shaft being rotated by the motor so as to impart the above-mentioned vibratory movement to the apparatus and thus the leveling blade (3). An actuator (37) provided on one of the handle bars (27) may be activated in order to control the force provided by the motor to the shaft (43), and thus in order to control the vibratory movement to be imparted to the blade (3).

As previously explained, the handling assembly (23) preferably comprises a pair of handle bars (27), each handle bar (27) having a lower end (67) provided with a corresponding connecting plate (29) being operatively connectable to the support bracket (5) by means of at least one fastener (69), and each connecting plate (29) is further operatively connectable to the support bracket (5) by means of at least one vibration-damping joint (25) made out of an elastomeric material for minimizing impartation of vibrations from the support bracket (5) to the handling assembly (23), as can be easily understood by a person skilled in the art when referring to FIGS. 12-16, 19-20 and 22-25.

Figure 13:
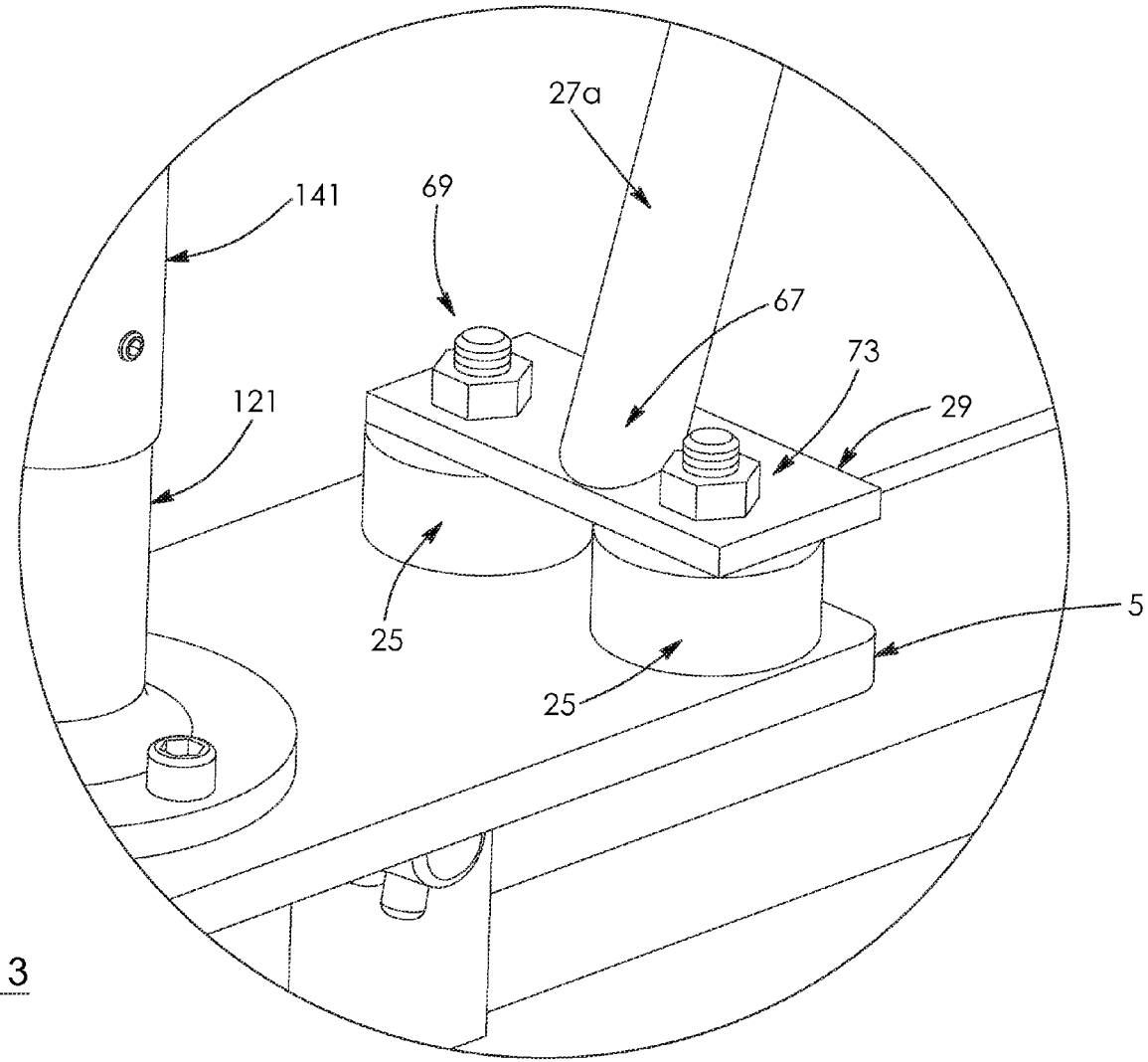
FIG. 13 is a partial enlarged view of a portion of what is shown in FIG. 12.
Figure 13A:
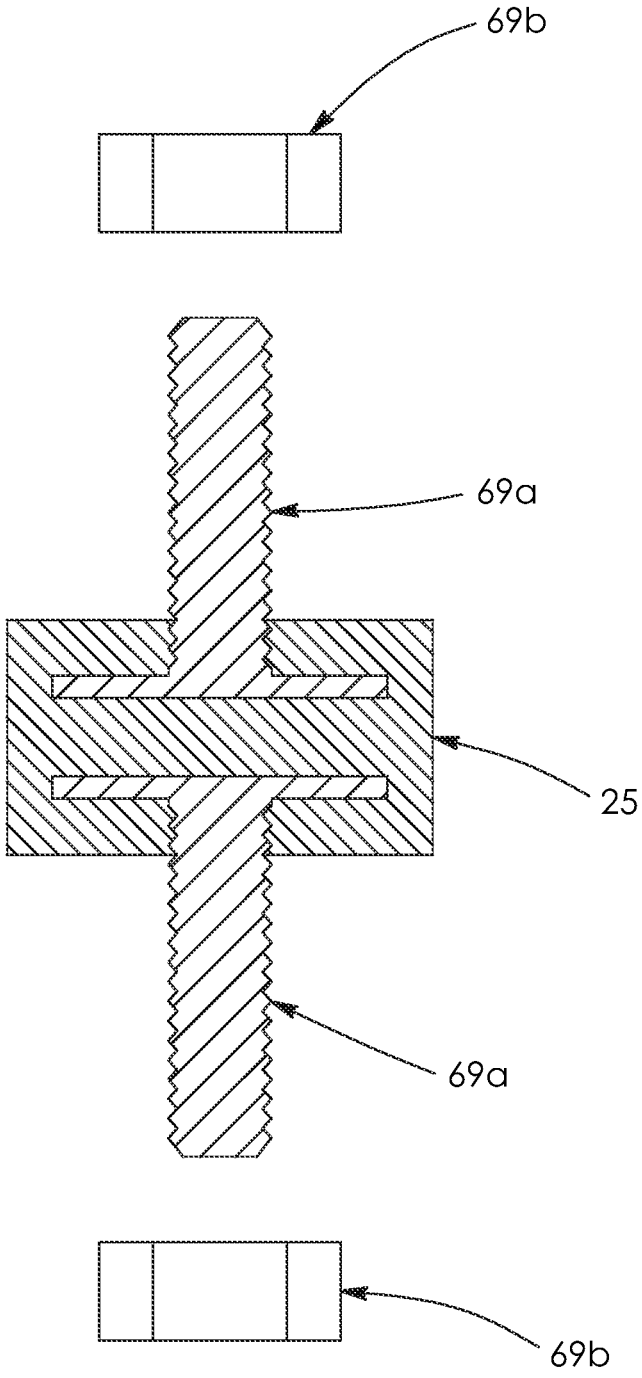
FIG. 13*a* is a schematic cross-sectional view of a vibration-damping joint shown in an exploded relationship with respect to a pair of corresponding fasteners according to a preferred embodiment of the present invention.
Figure 14:
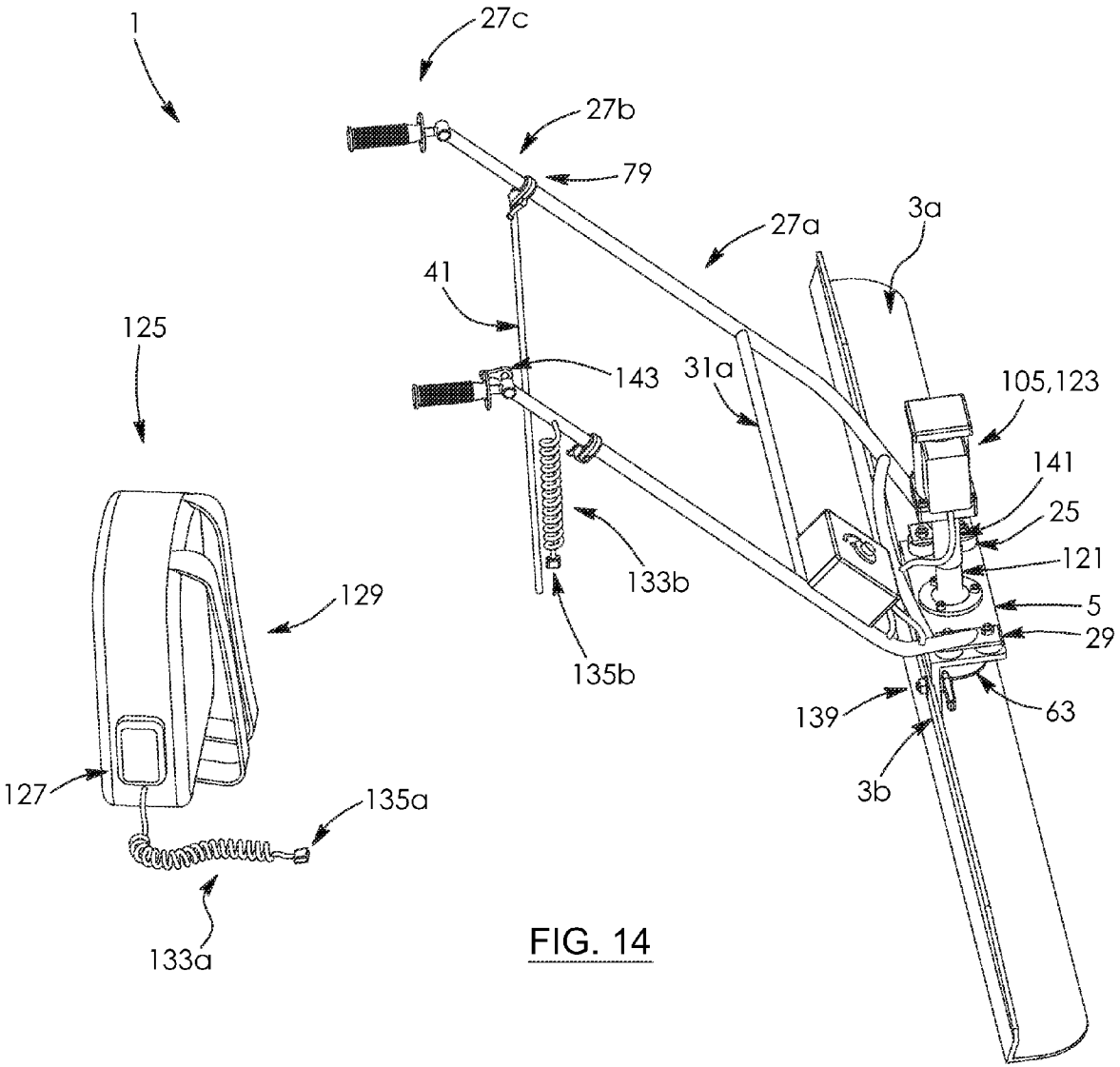
FIG. 14 is a top perspective view of what is shown in FIG. 12.

According to a given preferred embodiment of the present invention, as exemplified in FIGS. 12-20, each connecting plate (29) is operatively connectable to the support bracket (5) by means of a pair of vibration-damping joints (25), each vibration-damping joint (25) being substantially cylindrical, and being provided with first and second T-shaped fasteners (69*a*), each T-shaped fastener (69*a*) having a traversal portion embedded in the elastomeric material and a longitudinal portion being threaded and having an extremity projecting out from the elastomeric material, such that each vibration-damping joint (25) is removably connectable between a given connecting plate (29) and the support bracket (5) by means of a pair of corresponding complementary fasteners (69*b*) respectively mountable onto the extremities of the first and second T-shaped fasteners (69*a*), the transversal portions of said T-shaped fasteners (69*a*) being separate from one another within the elastomeric material of each vibration-damping joint (25) so as to minimize impartation of vibrations from the support bracket (5) to the handling assembly (23), as better shown in FIGS. 13 and 13*a*.

Figure 25:
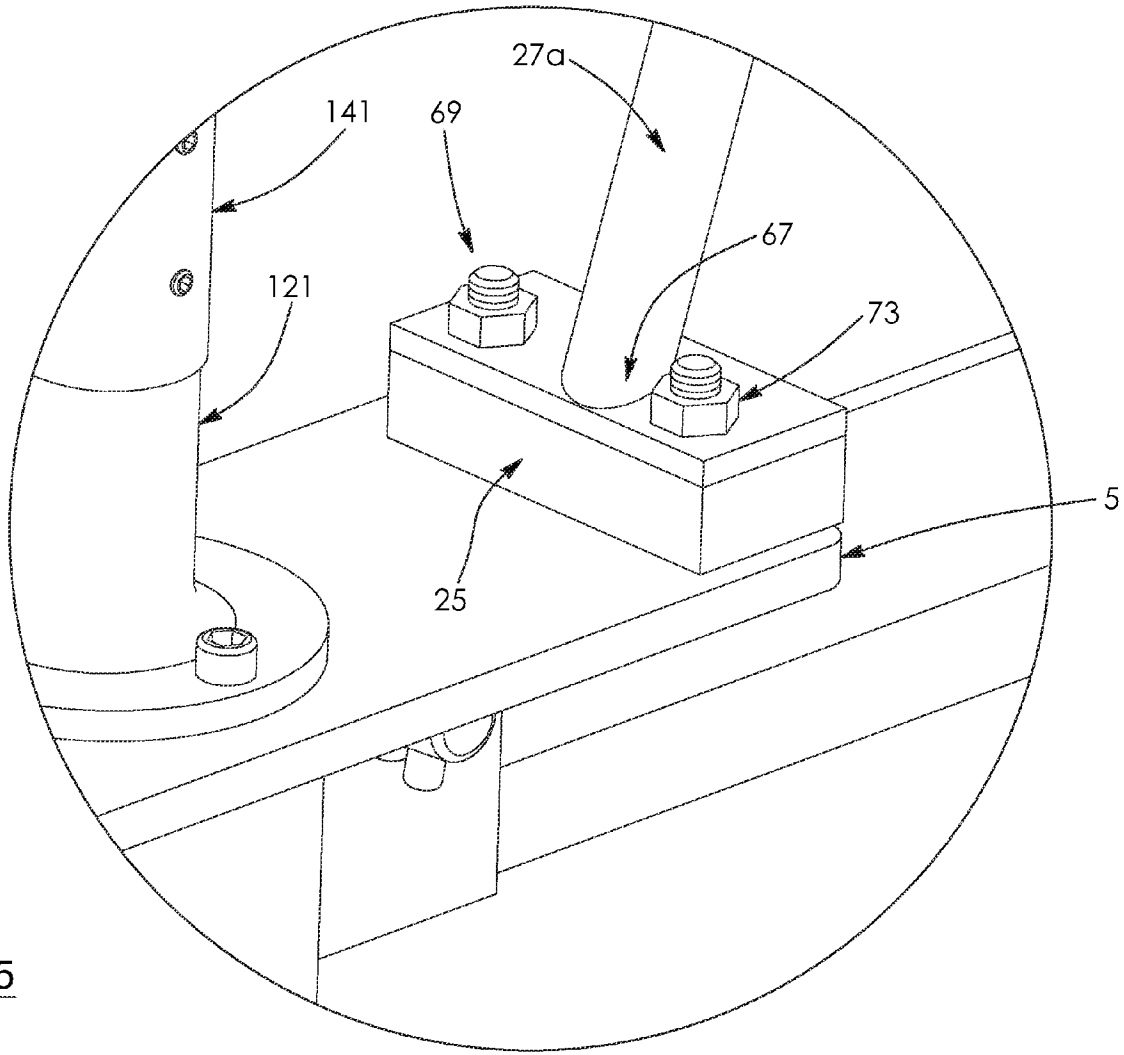
FIG. 25 is a partial enlarged view of a portion of what is shown in FIG. 22.
Figure 25A:
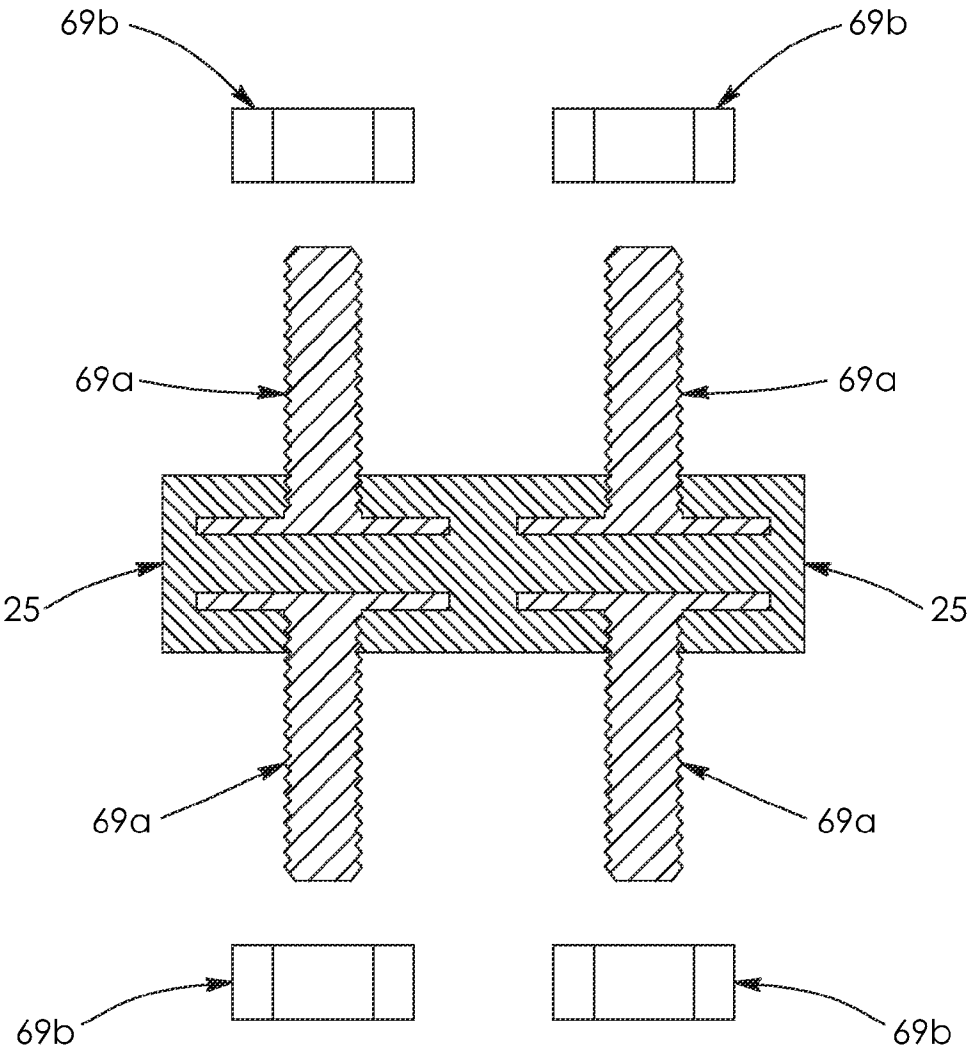
FIG. 25*a* is a schematic cross-sectional view of a vibration-damping joint shown in an exploded relationship with respect to pairs of corresponding fasteners according to another preferred embodiment of the present invention.
Figure 26:
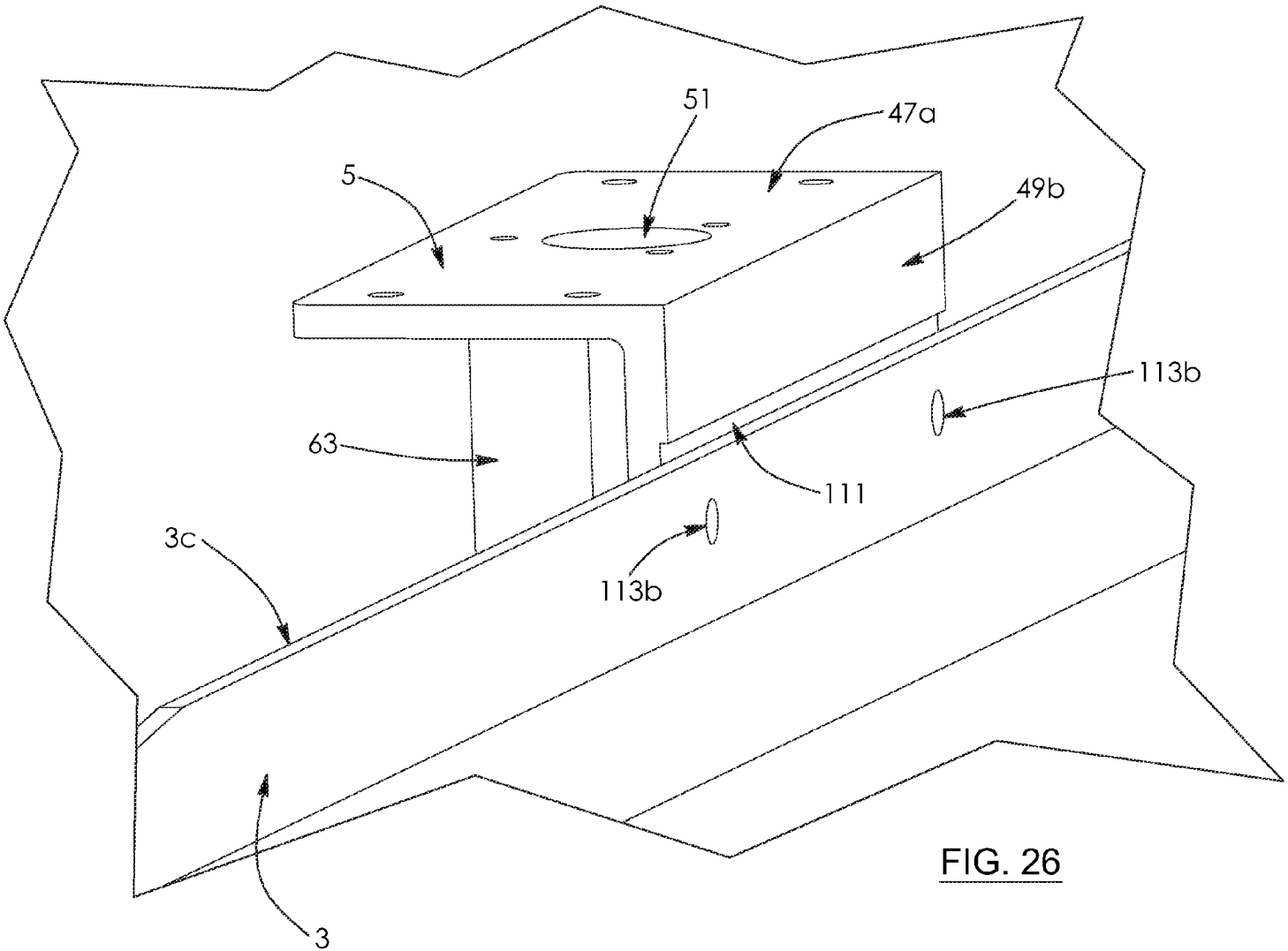
FIG. 26 is a partial perspective view of a support bracket with integrated casing, the rear side of the support bracket being provided with an integrated longitudinal shoulder extending across the support bracket for resting against an uppermost edge of the leveling blade according to a preferred embodiment of the present invention.
Figure 27:
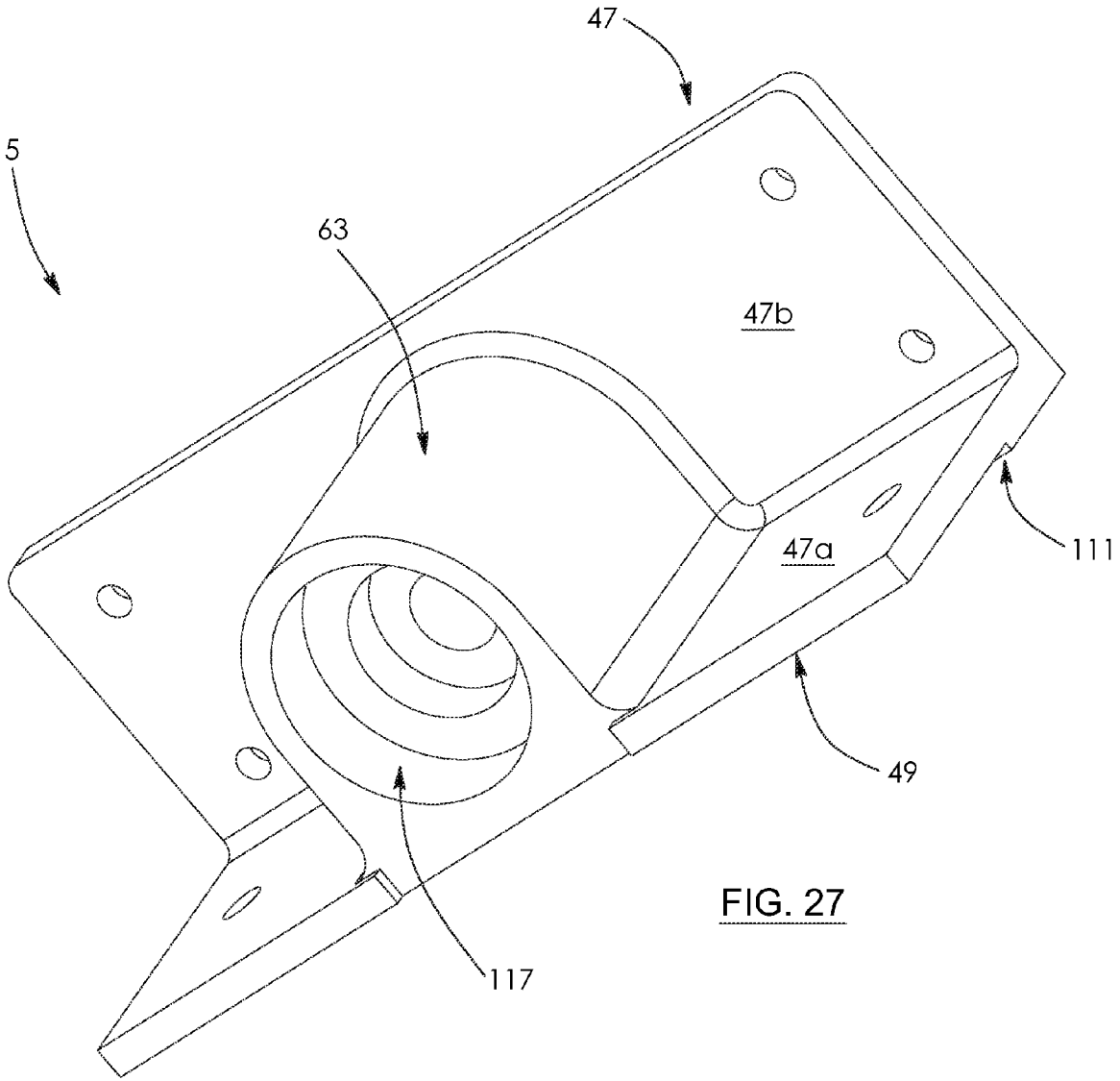
FIG. 27 is a bottom perspective view of a support bracket with integrated casing and integrated longitudinal shoulder according to a preferred embodiment of the present invention.
Figure 28:
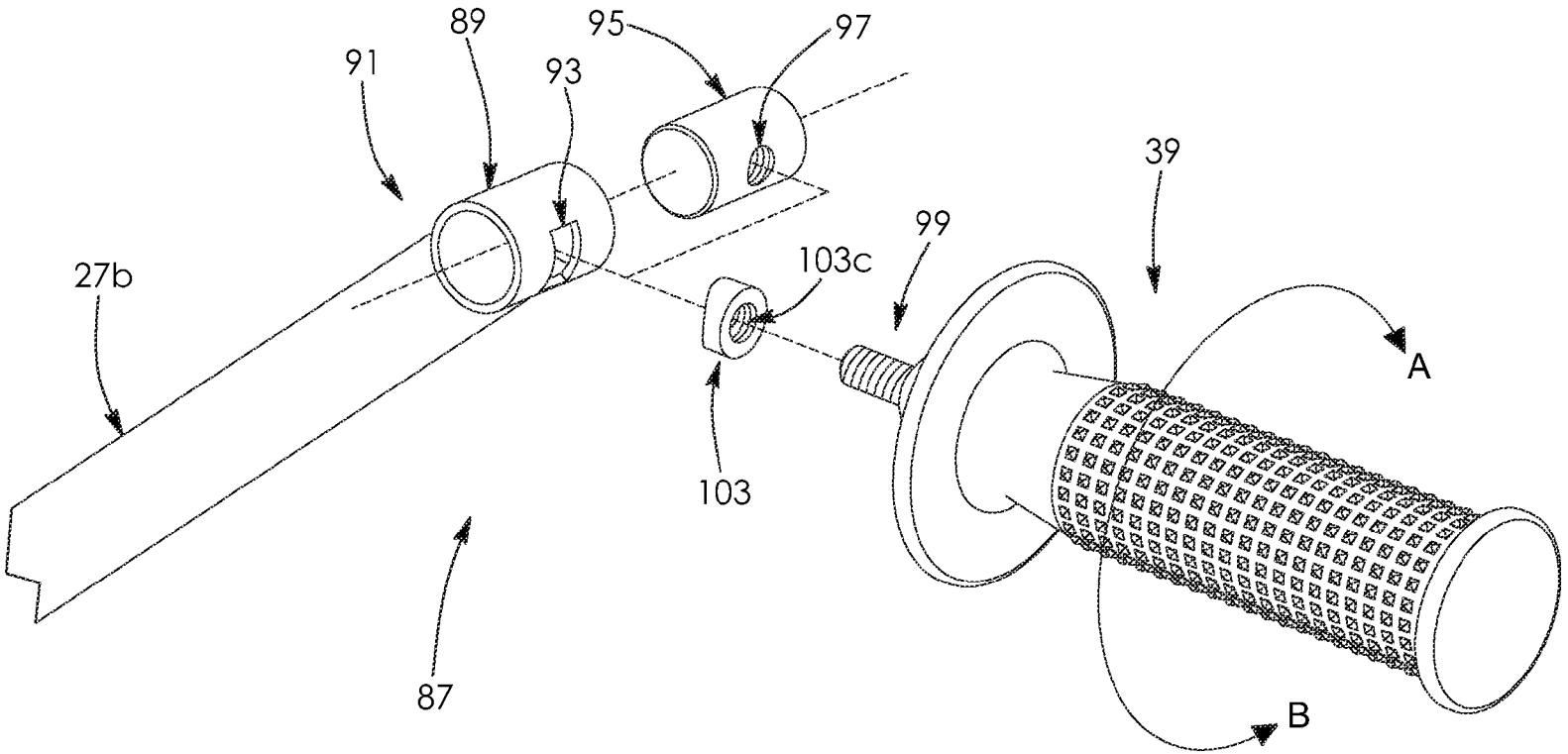
FIG. 28 is an exploded perspective view of a tilt-adjustment assembly cooperating between a distal end of a second section of a handle bar and a corresponding handle according to a preferred embodiment of the present invention.
Figure 29:
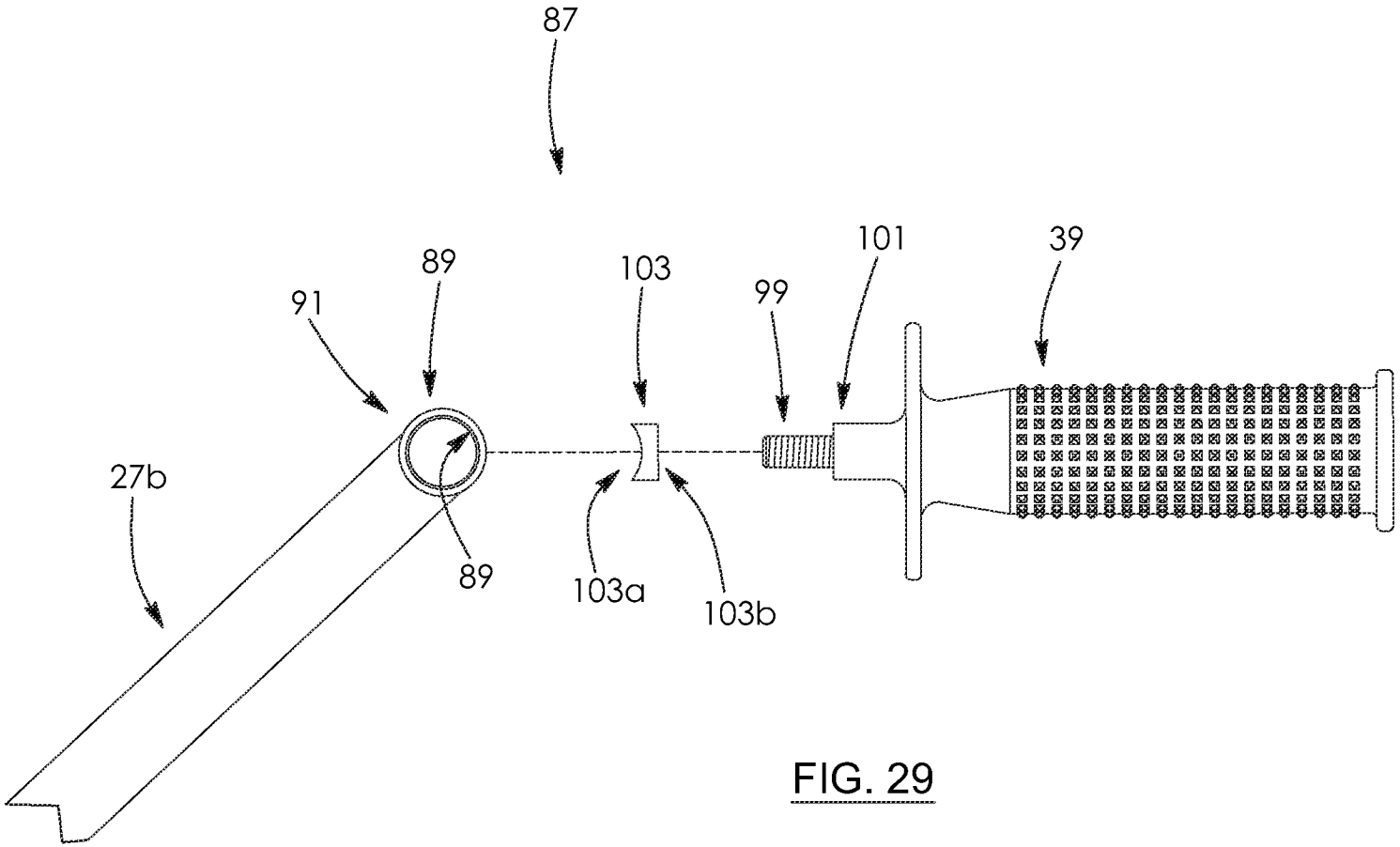
FIG. 29 is a side elevational view of what is shown in FIG. 28.
Figure 30:
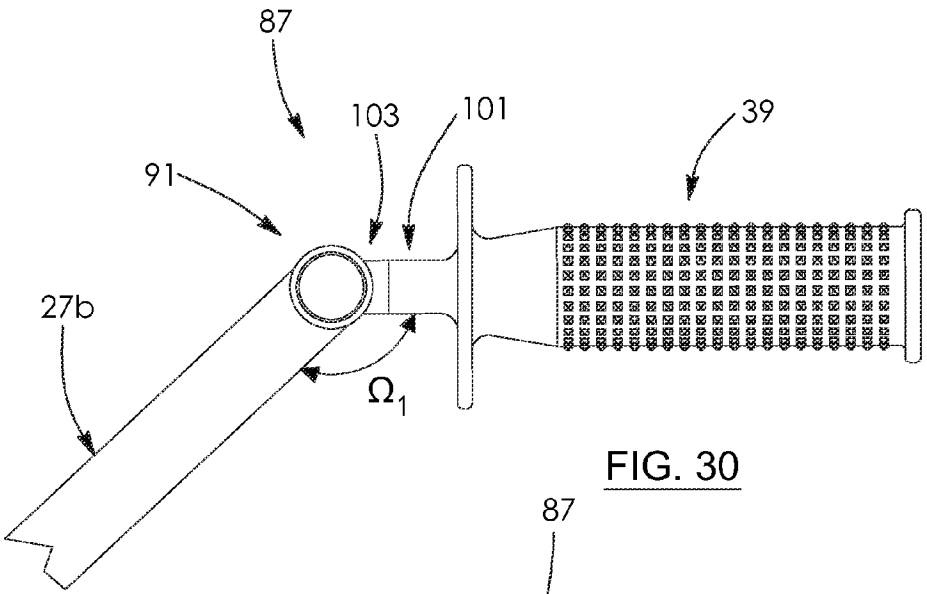
FIG. 30 is an assembled view of what is shown in FIG. 29, the handle being secured at a given selected angle with respect to the handle bar.
Figure 31:
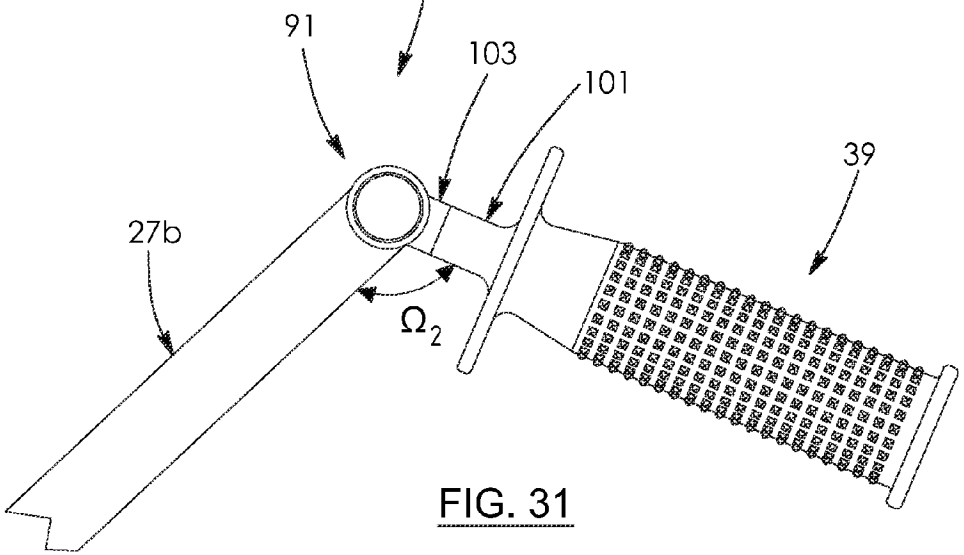
FIG. 31 is another side view of what is shown in FIG. 30, the handle being now shown secured at another given selected angle with respect to the handle bar.

Alternatively, and according to another preferred embodiment of the present invention, as exemplified in FIGS. 22-25, each connecting plate (29) may operatively connectable to the support bracket (5) by means of a single vibration-damping joint (25), each vibration-damping joint (25) being substantially rectangular-shaped, for example, and having a pair of T-shaped fasteners (69*a*), each pair cooperating with a corresponding pair of complementary fasteners (69*b*), as better shown in FIGS. 25 and 25*a*. It may be appreciated how by providing a single vibration-damping joint (25), such as a substantially rectangular-shaped vibration-damping joint (25), for example, as shown in FIG. 25, it is less likely that any material may enter between a given connecting plate (29) and a corresponding support bracket (5). Furthermore, this particular configuration is also advantageous in that a greater surface of the support bracket (5) is isolated from its neighboring connecting plate (29) due to the fact that the substantially rectangular-shaped vibration-damping joint (25) spans through the entire surface of the connecting plate (29).

As previously explained, each handle bar (27) preferably comprises first and second sections (27*a*,27*b*) being operatively connectable to one another, and the handling assembly (23) further preferably comprises at least one cross-bar (31) extending between the first sections (27*a*) of the handle bars (27).

Figure 20:
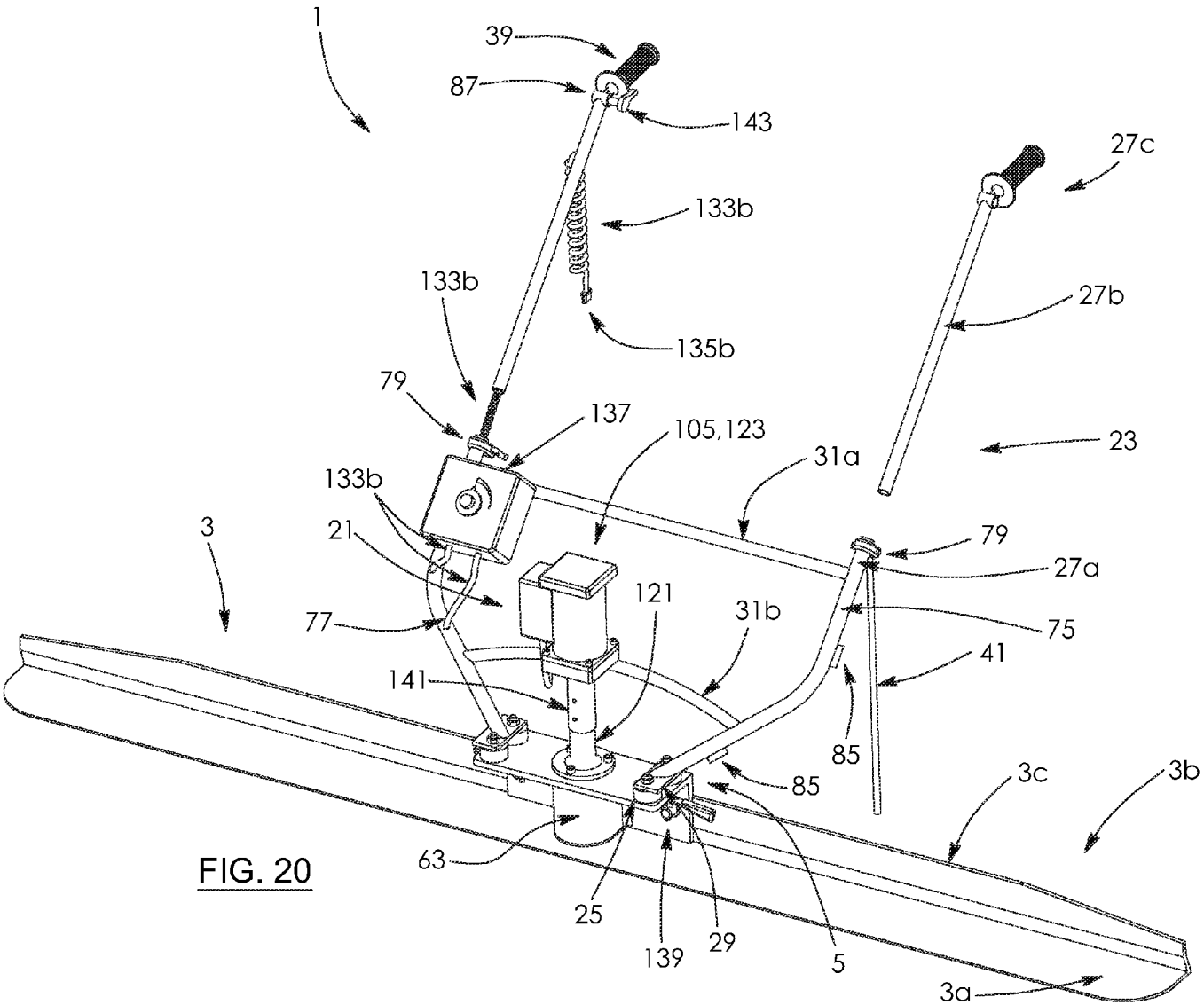
FIG. 20 is a perspective view of a vibrating screed according to yet another preferred embodiment of the present invention, the second sections of the handle bars being shown in an exploded relationship with respect to the first sections thereof.
Figure 21:
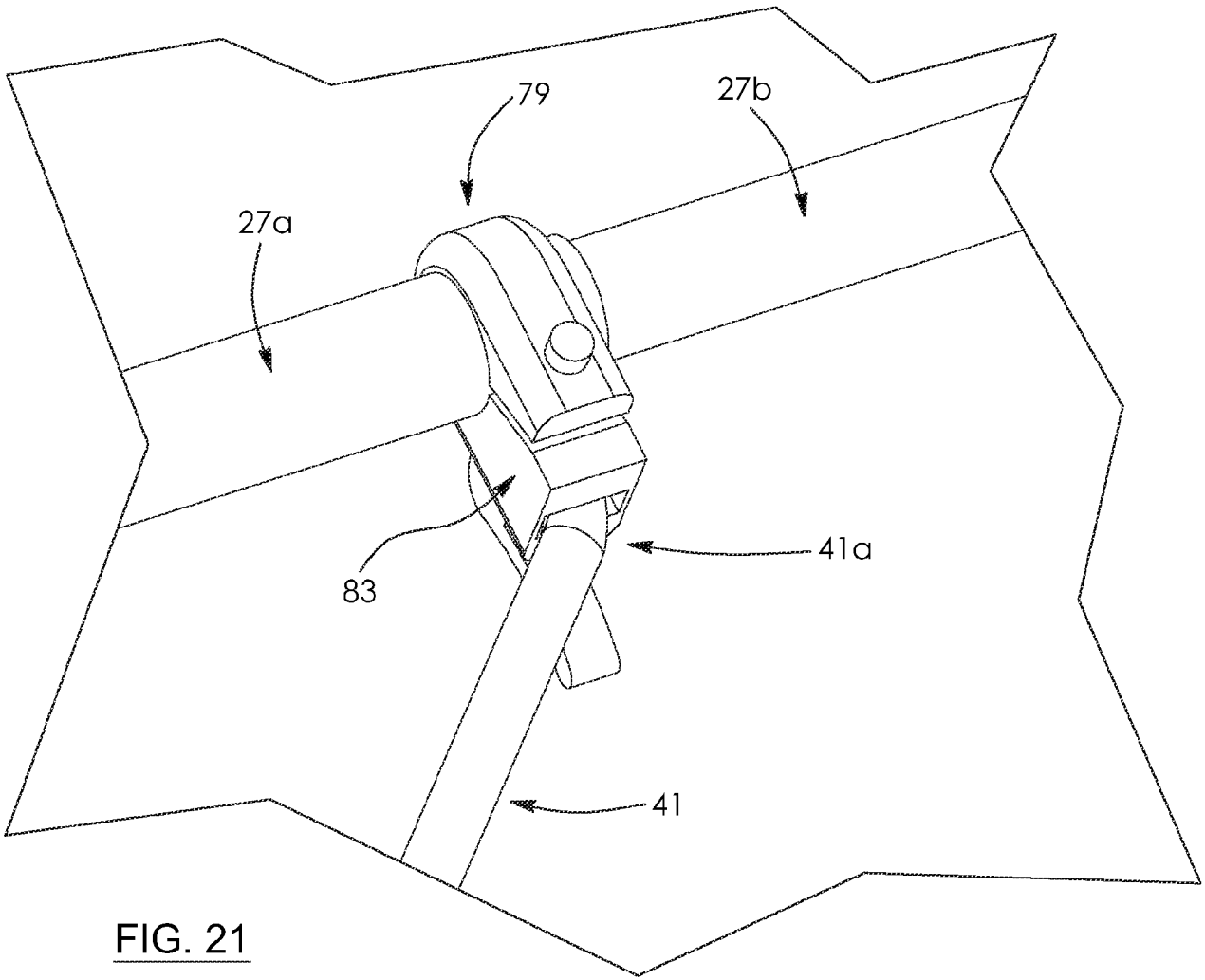
FIG. 21 is a partial perspective view of a clamp mechanism provided about a distal open end of a first section of a handle bar, with a second section of the handle bar being slidably inserted into the first section, the clamp mechanism being provided with a projecting flange about which the support leg is allowed to pivot according to a preferred embodiment of the present invention.
Figure 22:
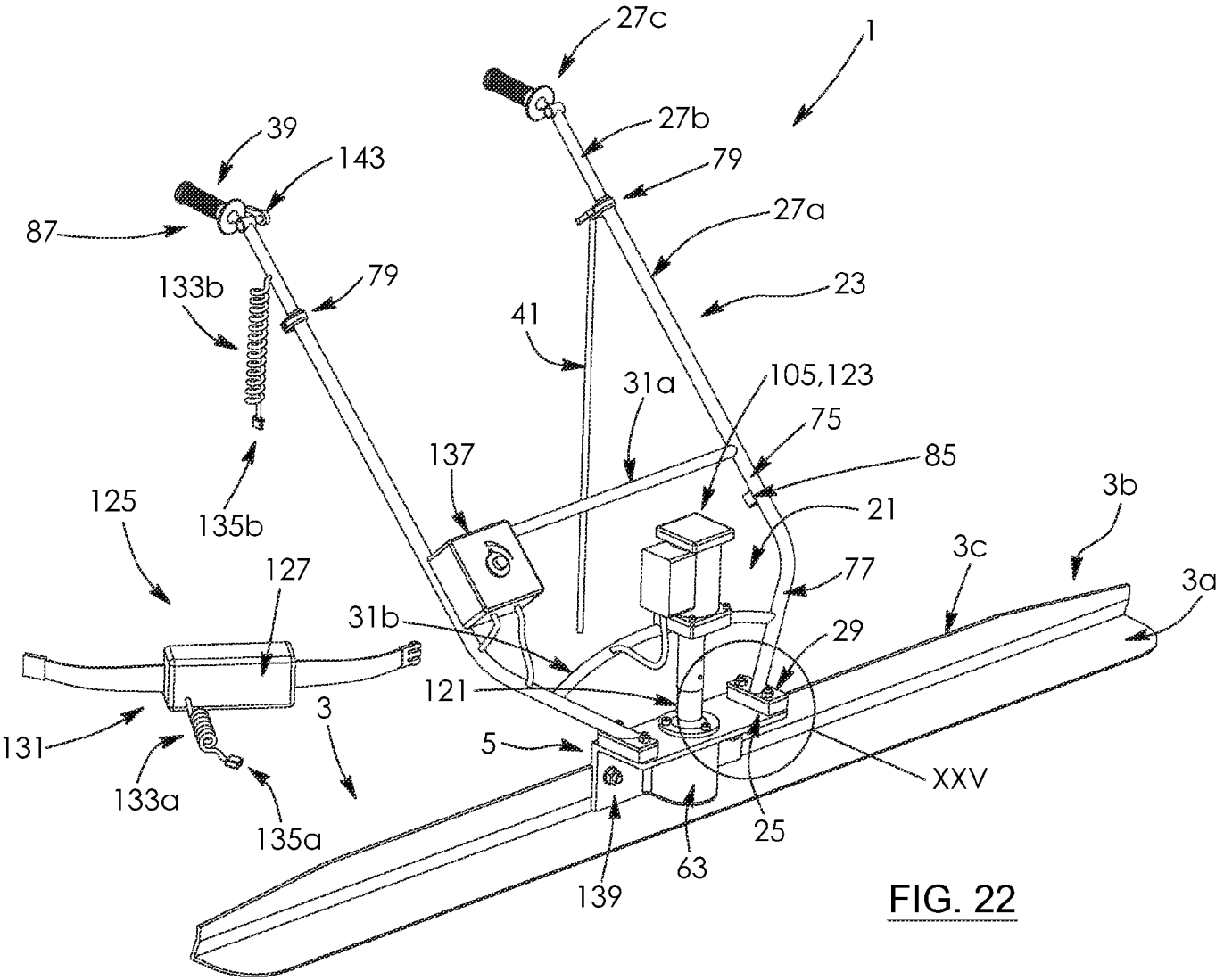
FIG. 22 is a perspective view of a vibrating screed provided with a portable power supply separate from the vibrating screed according to another preferred embodiment of the present invention.

According to another particular embodiment of the present invention, as better shown in FIG. 20, for example, the first sections (27*a*) of the handle bars (27) each comprise a straight section (75) and an inwardly-slanted section (77), and the handling assembly (23) comprises first and second cross-bars (31*a*,31*b*), the first cross-bar (31*a*) being a substantially straight cross-bar (31*a*) extending between the straight sections (75) of the first sections (27*a*) of the handle bars (27), and the second cross-bar (31*b*) being a substantially arched cross-bar (31*b*) extending between the inwardly-slanted sections (77). The provision of a pair of cross-bars (31) in the manner exemplified in the accompanying drawings further increases the structural integrity of the handling assembly (23) and of the resulting vibrating screed (1), and the presence of a substantially arched cross-bar (31) makes it easier for a user to simply pick up the device, the vibrating screed (1), or a portion thereof, for improved manipulation and/or transportation.

When referring to FIGS. 3 and 4, it was shown how the second section (27*b*) of each handle bar (27) could be adjustably pivotable with respect to the first section (27*a*) thereof, and against a first cross-bar (31). However, according to another preferred embodiment of the present invention, as exemplified in FIGS. 12-15 and 20-23, the second section (27*b*) of each handle bar (27) is removably insertable into the first section (27*a*) thereof, and is telescopically adjustable with respect to said first section (27*a*) by means of a clamp mechanism (79). Preferably also, the first and second sections (27*a*,27*b*) of each handle bar (27) comprise hollow tubes, the hollow tube of the second section (27*b*) being insertable into the hollow tube of the first section (27*a*) thereof via a distal open end (81).

As better shown in FIGS. 12, 15, 20 and 21, at least one handle bar (27) is removably provided with a support leg (41) for supporting the vibrating screed (1) when not in use, the support leg (41) having first and second extremities (41*a*, 41*b*), the first extremity (41*a*) being removably and pivotably mountable onto a supporting flange (83) projecting downwardly from a corresponding clamp mechanism (79). Preferably also, the support leg (41), when not in use, is removably secured against a corresponding retaining mechanism (85) provided on the same handle bar (27) as that of the corresponding clamp mechanism (79), as exemplified in FIGS. 20, 22 and 23. The corresponding retaining mechanism (85) may come in various different forms, such as a clip, a hook, or simply a corresponding magnet, which may be conveniently located on the first section of the given handle bar (27), whether on the straight section (75) thereof, or on the inwardly-slanted section (77), as better shown in FIG. 20, or on any other suitable location of the vibrating screed (1), so that the support leg (41) (or simply "stand") may be conveniently and appropriately retracted out of the way so as to enable the user of the vibrating screed (1) to operate the same conveniently.

Preferably also, the distal open end (81) of the first section (27*a*) of each handle bar (27) is positioned in proximity to the first cross-bar (31*a*), and each clamp mechanism (79) is mounted adjacent to the distal open end (81) of the hollow tube of each first section (27*a*) of the handling assembly (23), as also better shown in FIG. 20. This is particularly advantageous in that, by providing such a configuration, less space is required for storing components of the vibrating screed (1) for transportation, shipping and/or storage purposes. Indeed, a smaller, and more elongated box could be used given that the bottom portion of the vibrating screed (1) is shortened due to the fact that the distal open end (81) of the first section (27*a*) of each handle bar (27) is positioned adjacent to where the first cross-bar (31*a*) intersects the first sections (27*a*), as can be easily understood by a person skilled in the art when referring to FIG. 20.

As previously explained, each handle bar (27) also preferably comprises a third section (27*c*) operatively connected to the second section (27*b*) thereof, the third section (27*c*) including a handle (39) and being selectively adjustable in angle with respect to the second section (27*b*) along a substantially vertical plane via a tilt-adjustment assembly (87). This tilt-adjustment assembly (87) according to the present invention is particularly advantageous in that it enables for a given user of the vibrating screed (1) to adjust the handle (39) with respect to the second section (27*b*) of the handle bar (27), at a given selected operating angle, in a very easy, quick and convenient manner, without the use of any tools. Indeed, as can be understood when referring to FIGS. 28-31, the tilt-adjustment assembly (87) preferably comprises a sleeve (89), a pivot barrel (95) and a screw component (99).

According to a preferred embodiment, the sleeve (89) is provided transversally with respect to the second section (27*b*) of each handle bar (27), at a distal end (91) thereof, the sleeve (89) being provided with a given slit (93) defining a range of possible angle configuration for the handle (39). The pivot barrel (95) is removably insertable into the sleeve (89) and has a threaded socket (97), the pivot barrel (95) being rotatable inside the sleeve (89) so that its threaded socket (97) be displaceable along the given slit (93) of the sleeve (89). The screw component (99) projects from the handle (39) and is threadedly insertable into the threaded socket (97) of the pivot barrel (95) via a rotation of the handle (39) along a given rotative direction (A,B), whether a clockwise rotative direction (A), or a counter-clockwise rotative direction (B), the screw component (99) being provided with a shouldering flange (101) configured for being forced against the sleeve (89) of the distal end (91) of the handle bar (27) when the screw component (99) has reached a given distance inside the threaded socket (97) so as to maintain the handle (39) pressed at a given selected angle (Q) with respect to the sleeve (89) within the range of possible angle configuration provided by the slit (93).

Preferably also, the tilt-adjustment assembly (87) further comprises a locking washer (103) having a front face (103*a*) cooperable with the sleeve (89) and an opposite rear face (103*b*) cooperable with the shouldering flange (101), an inner bore (103*c*) being defined between said opposite front and rear faces (103*a*,103) for allowing the screw component (99) to pass therethrough, the front face (103*a*) of the locking washer (103) having a concave configuration complementary to the outer shape of the sleeve (89) so that tightening of the shouldering flange (101) against the sleeve (89) via the locking washer (103*a*) further aids in maintaining the handle (39) secured against the sleeve (89) at the given selected angle (Ω).

As previously explained, the vibration-generating assembly (21) comprises a motor assembly (105) cooperating with a shaft assembly (43), the shaft assembly (43) being drivable by the motor assembly (105) and having an extremity provided with an eccentric cam (45) so as to impart vibrations when rotatably driven by the motor assembly (105).

According to a given preferred embodiment of the present invention, the eccentric cam (45) is removably mountable onto the extremity of the shaft assembly (43), the eccentric cam (45) comprising a bore (53) for inserting into the extremity of the shaft assembly (43), and a transversal hole (55) for receiving a fastener (69) for removably securing the cam (45) onto the shaft assembly (43).

Figure 15:
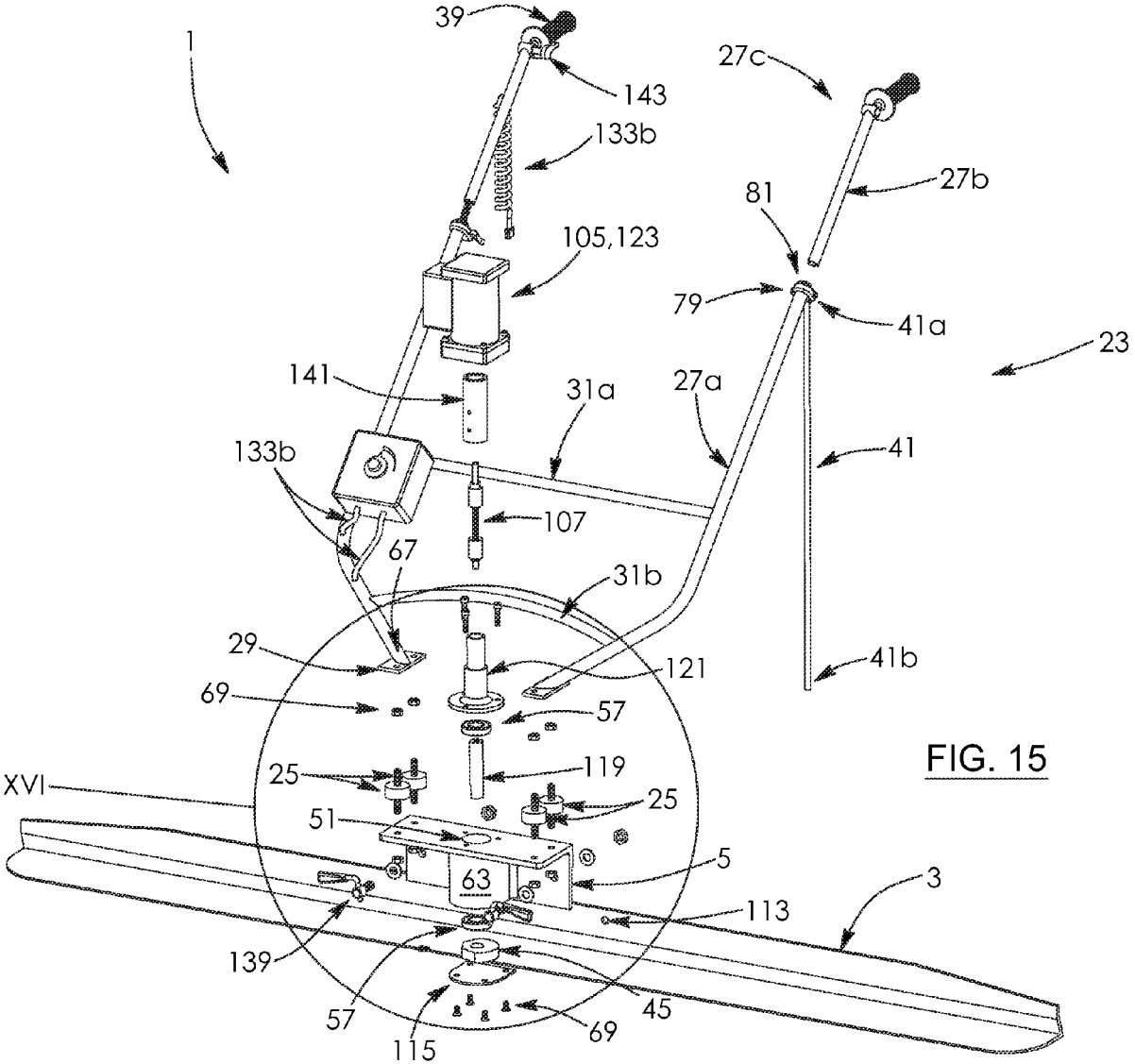
FIG. 15 is an exploded view of several components of the vibrating screed shown in FIG. 12.
Figure 16:
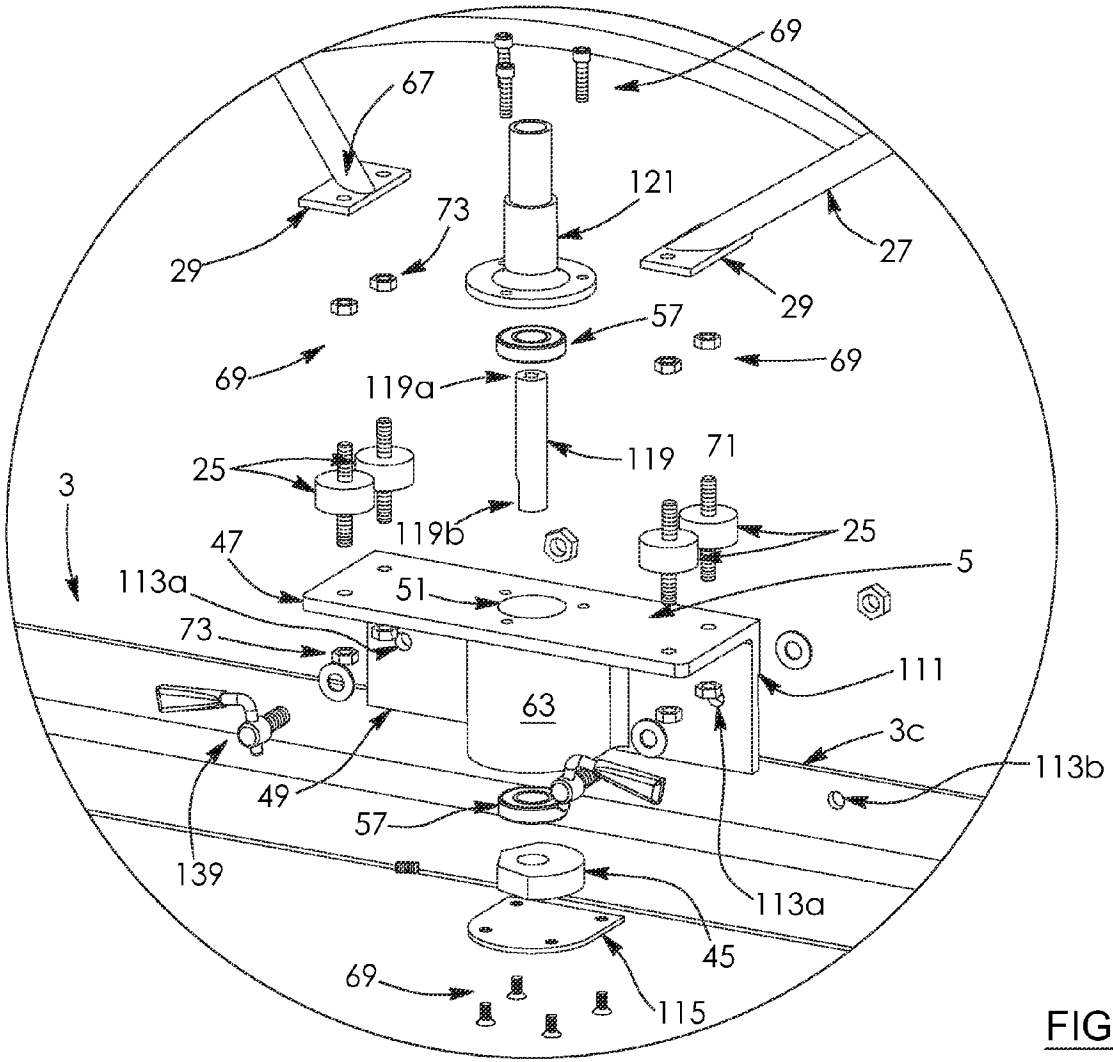
FIG. 16 is a partial enlarged view of what is a portion of what is shown in FIG. 15.
Figure 23:
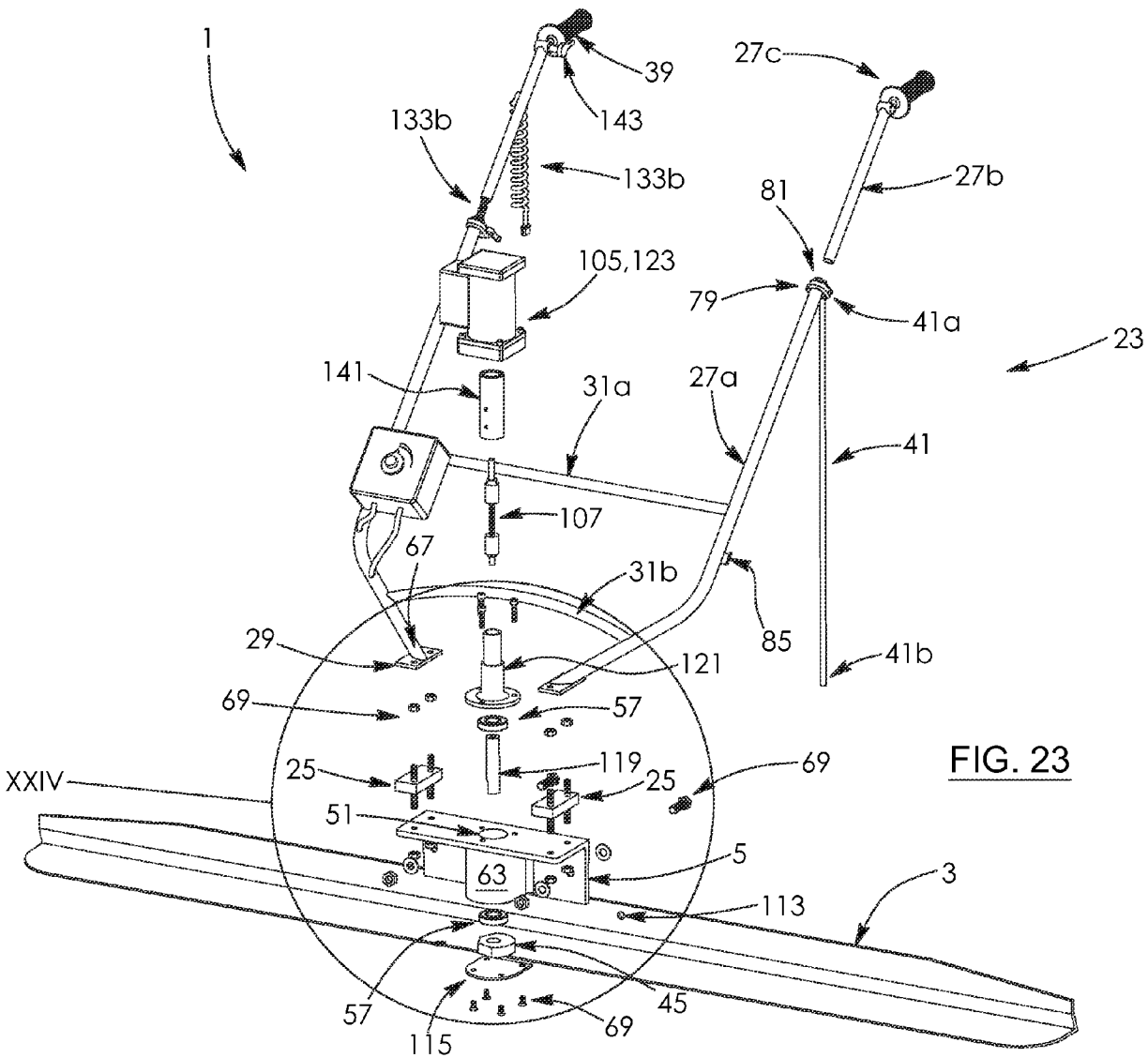
FIG. 23 is an exploded view of several components of the vibrating screed shown in FIG. 22.
Figure 24:
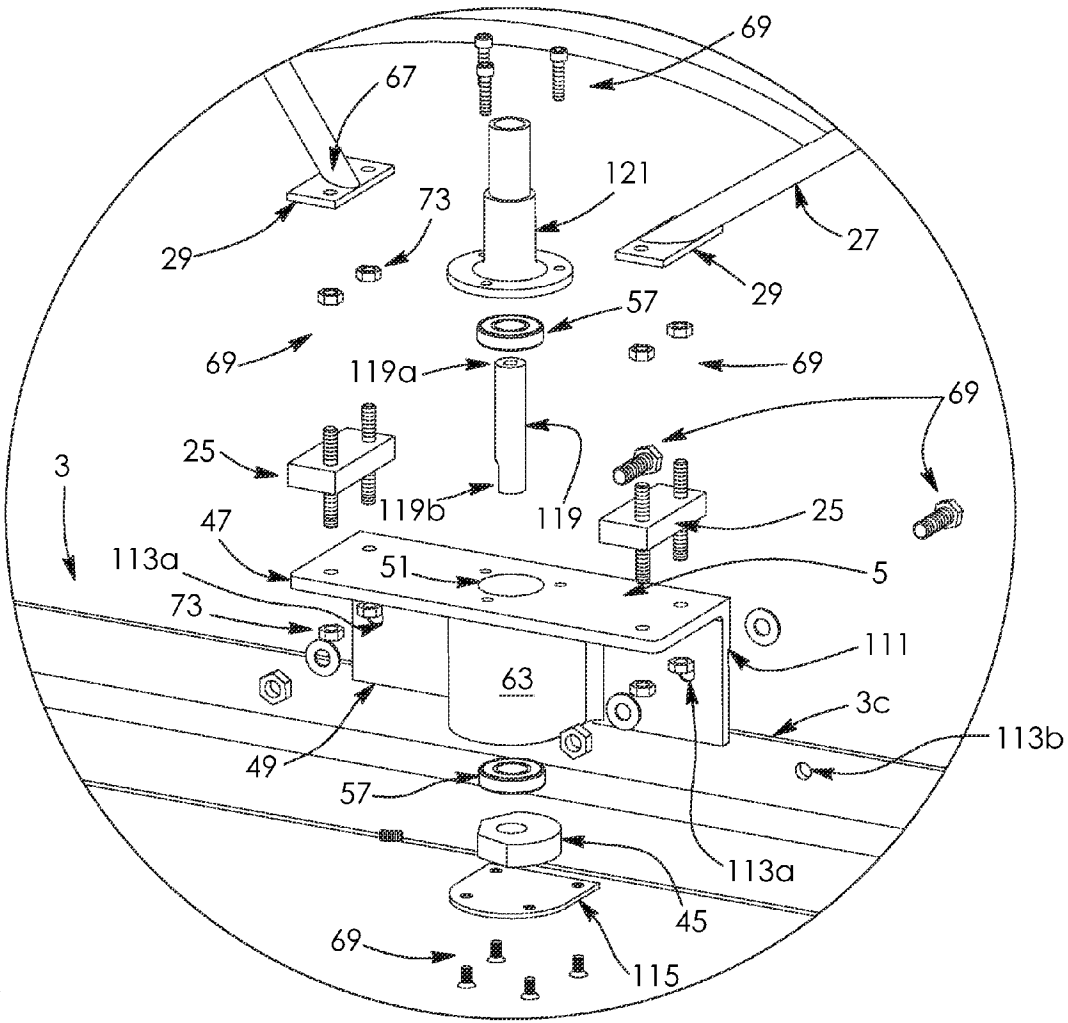
FIG. 24 is a partial enlarged view of a portion of what is shown in FIG. 23.

As better shown in FIGS. 15-19 and 23-24, a substantial improvement of the present invention resides in that the shaft assembly (43) of the vibrating screed (1) comprises a flexible engine shaft (107), the flexible engine shaft including a first end (107*a*) operatively connectable to the motor assembly (105), a second end (107*b*) operatively connectable to the eccentric cam (45), and an interconnecting portion (107*c*) for interconnecting the first end (107*a*) to the second end (107*b*), the first and second ends (107*a*,107*b*) of the flexible engine shaft (107) being substantially rigid, whereas the intermediate portion (107*c*) being substantially flexible, and the eccentric cam (45) being operatively drivable by the motor assembly (105) via the engine flexible shaft (107), as can be easily understood by a person skilled in the art when referring to FIGS. 15 and 23, for example.

Figure 17:
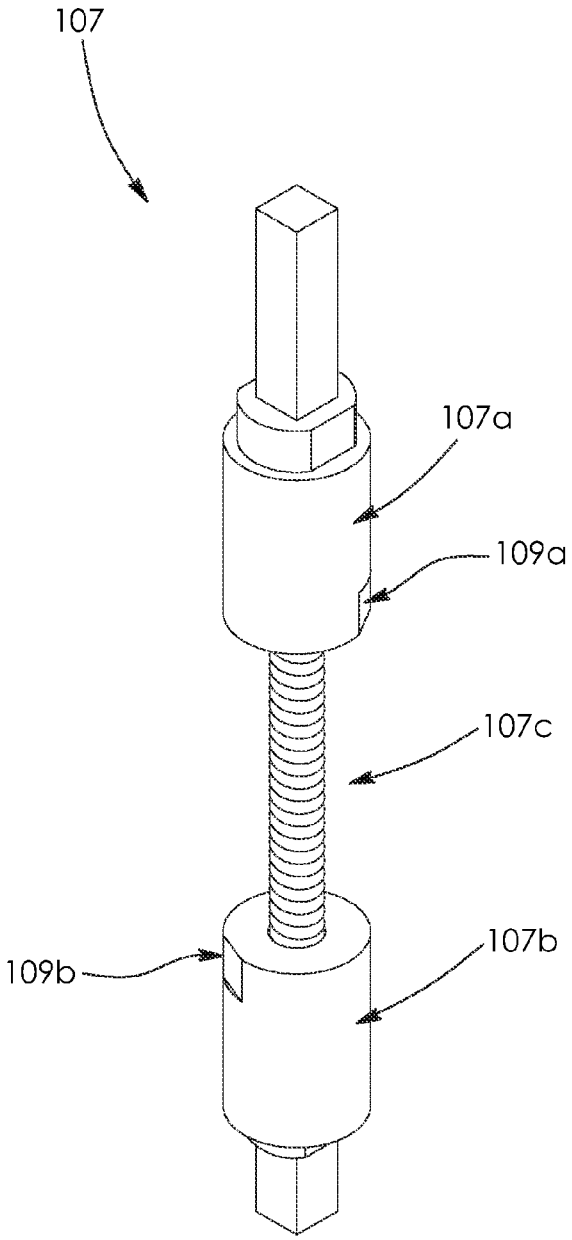
FIG. 17 is a perspective view of a flexible engine shaft according to a preferred embodiment of the present invention.
Figure 18:
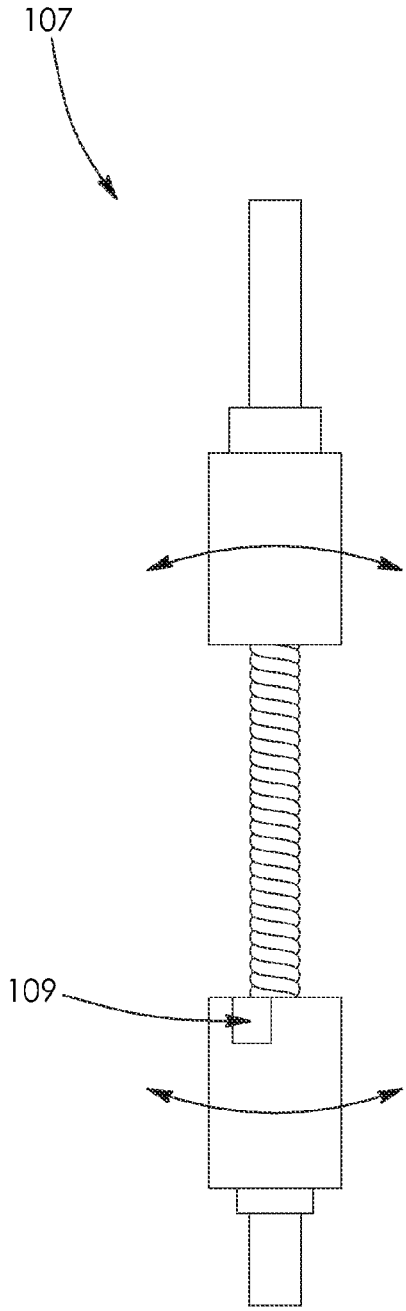
FIG. 18 is a side elevational view of what is shown in FIG. 17.
Figure 19:
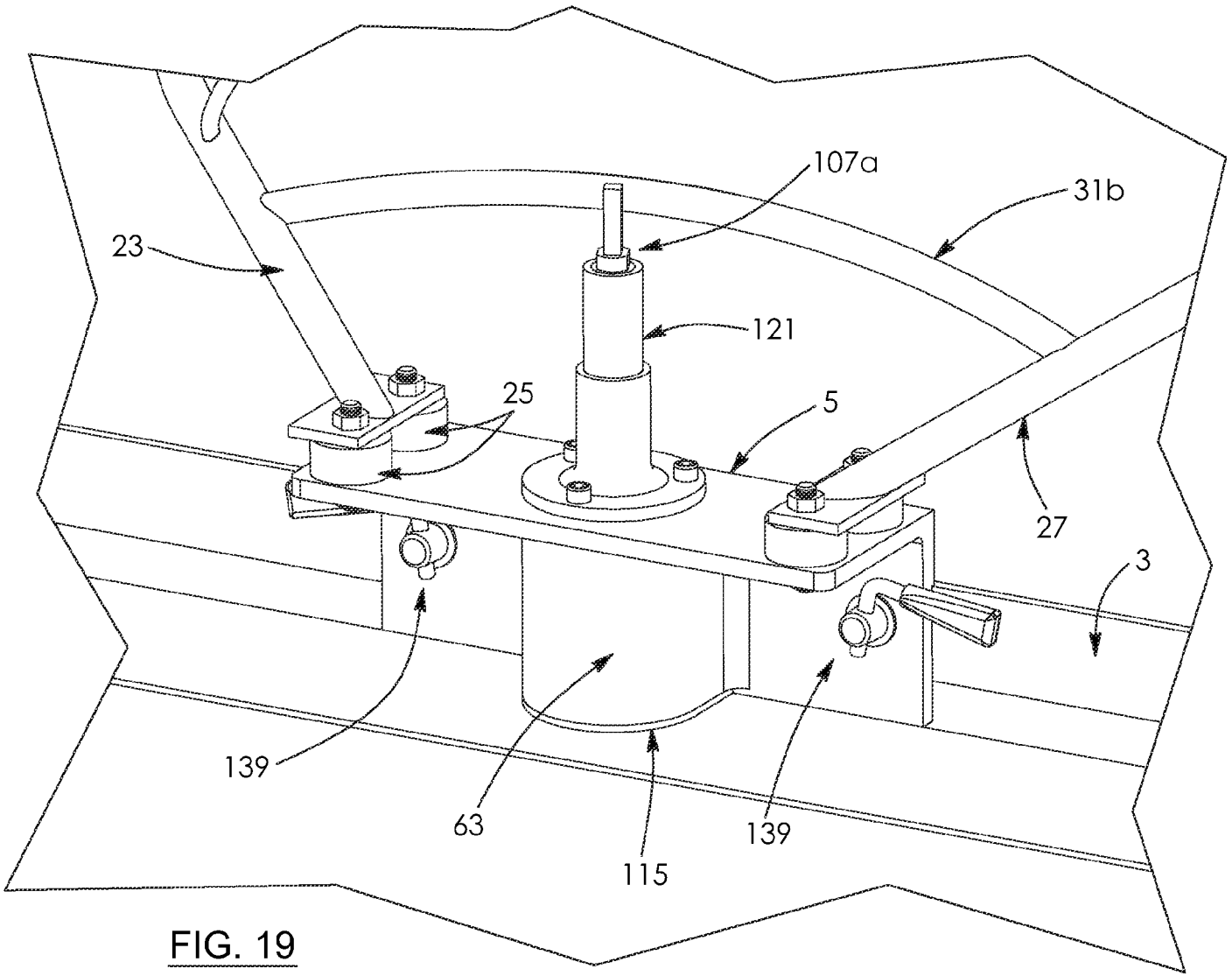
FIG. 19 is another partial enlarged view of what is shown in FIG. 15, the components being now shown assembled according to a preferred embodiment of the present invention, better illustrating how the flexible engine shaft projects from the shaft housing when it is inserted therein.

As better shown in FIGS. 17 and 18, and according to a preferred embodiment of the present invention, the first and second ends (107*a*,107*b*) of the flexible engine shaft (107) are machined parts, and the interconnecting portion (107*c*) is made up of a coiled material for providing the interconnecting portion (107*c*) with substantial elastic flexibility, as can be easily understood when referring to FIG. 17. This is particularly advantageous in that, given the fact that vibrations are transmitted between different components of the vibrating screed (1), in order to avoid fatigue wear or breakage of what would be normally a unitary and rigid monoshaft according to the prior art, the vibrating screed (1) according to the present invention is provided with a flexible engine shaft (107) which is much less likely to break, given that its flexible interconnecting portion (107*c*), which may undergo elastic deformation, that is, which is preferably designed so as to be deformed, but returned back to its original configuration, may withstand displacements or loads between neighboring components of the vibrating screed (1) (for example, if the motor assembly (105) is slightly "displaced" or "vibrated" with respect to the support bracket (5) due to different considerations, etc.).

Preferably, the first and second ends (107*a*,107*b*) of the flexible engine shaft (107) are each provided with at least one notch (109*a*,109*b*), each notch (109*a*) of the first end (107*a*) being rotatably offset with respect to each notch (109*a* b) of the second end (107*b*), as better shown in FIGS. 17 and 18, for ensuring proper operation and orientation of the flexible engine shaft (107) with respect to the different components that it is intended to cooperate with, as can be easily understood by a person skilled in the art. As will be explained in greater detail hereinbelow, other suitable cooperations between the flexible shaft (107) and its corresponding neighboring components may be used according to the present invention, in order to ensure a proper interaction between said flexible shaft (107) and corresponding neighboring components, depending on the particular applications for which the vibrating screed (1) is intended for, and the desired end result, as also apparent to a person skilled in the art.

Another innovative aspect of the present vibrating screed (1) resides in the fact that the substantially horizontal portion (47) of the support bracket (5) comprises top and bottom sides (47*a*,47*b*), and the substantially vertical portion (49) of said support bracket (5) comprises front and rear sides (49*a*,49*b*), the rear side (49*b*) being provided with an integrated longitudinal shoulder (111) extending across the support bracket (5) for resting against an uppermost edge (3*c*) of the leveling blade (3). This is particularly advantageous in that contrary to conventional vibrating screeds where the entire load of the support bracket and of all other components mounted thereon is taken on solely by the corresponding fasteners which removably connect the support bracket to the leveling blade, a substantial portion of this overall entire weight is now supported by the uppermost edge (3*c*) of the leveling blade (3), thereby allowing for less load to be taken on by the corresponding fasteners (69) or connectors (139), which intend to join the support bracket (5) to the leveling blade (3).

Advantageously also, the longitudinal shoulder (111) is positioned at given location about the rear side (49*b*) of the substantially vertical portion (49) of the support bracket (5) so that holes (113*a*,113*b*) provided on the support bracket (5) and on the leveling blade (3) may be conveniently aligned when the longitudinal shoulder (111) of the support bracket (5) is rested against the uppermost edge (3*c*) of the leveling blade (3). The leveling blade (3) is removably securable onto the support bracket (5) via at least one connector (139), whether a conventional fastener assembly, such as a traditional bolt and nut assembly, or easy clamps/clips, as exemplified in FIGS. 16, 19 and 24.

Another innovative aspect of the present invention resides in the provision of integrated casing (63) which is made integral (i.e. made of the same material, and of the same piece) to the support bracket (5). Indeed, according to a preferred aspect of the present invention, the support bracket (5) is provided with a through-hole (51) extending from the top side (47*a*) to the bottom side (47*b*) of its substantially horizontal portion (47) to allow a shaft of the vibration-generating assembly (21) to extend therethrough, the support bracket (5) further comprising an integrated casing (63) extending between the bottom side (47*b*) of its substantially horizontal portion (47) and the front side (49*a*) of its substantially vertical portion (49), the casing (63) being positioned under the through-hole (51) and configured for containing components of the vibration-generating assembly (21), said components being accessible via a bottom cover (115) removably mountable via fasteners onto a bottom opening (117) of the casing (63). This particular feature of the present invention is also useful and practical in that, due to its design, there is very little or practically no need to access components within the casing (63), given that they are advantageously protected by said integrated casing (63), thereby facilitating the use of the present vibrating screed (1), and the only component which is intended to normally project out from the casing (63) when the motor assembly (105) is removed, is the flexible engine shaft (107), as can be easily understood by a person skilled in the art when referring to FIGS. 15 and 16, and as better shown in FIG. 19.

Indeed, as shown in these figures, and according to a preferred embodiment of the present invention, the vibration-generating assembly (21) comprises:

a drive shaft (119) having first and second extremities (119*a*,119*b*), the drive shaft (119) being containable within the casing (63) of the support bracket (5);

an eccentric cam (45) containable within the casing (63) and mountable about the second extremity (119*b*) of the drive shaft (119);

at least one support bearing (57) mountable within the casing (63) and about the drive shaft (119) so allow the drive shaft (119) to rotate within the casing (63) by means of said at least one support bearing (57);

a shaft housing (121) mountable onto the top side (47*a*) of the support bracket (5), over the through-hole (51), the shaft housing (121) being configured for projecting upwardly from the top side (47*a*) of the support bracket (5);

a flexible engine shaft (107) insertable into the shaft housing (121), the flexible engine shaft (107) having substantially rigid first and second ends (107*a*,107*b*), and a substantially flexible interconnecting portion (107*c*) interconnecting the first and second ends (107*a*,107*b*), the second end (107*b*) of the flexible engine shaft (107) being cooperable with the first extremity (119*a*) of the drive shaft (119) for driving said drive shaft (119); and a motor assembly (105) mountable onto the shaft housing (121) and operatively cooperable with the first end (107*a*) of the flexible engine shaft (107) for driving said flexible engine shaft (107) and in turn driving the drive shaft (119) being provided with the eccentric cam (45) so as to impart vibrations to the vibrating screed (1).

Preferably also, and referring back to the integrated casing (63), this integrated casing (63) is preferably configured, that is, positioned, shaped and sized, so that when the support bracket (5) is removably mountable onto the leveling blade (3), there is a minimal space between the bottom cover (115) of the integrated casing (63) and the top side (11*a*) of the substantially horizontal portion (11) of the leveling blade (3), or alternately, so that there is no space thereinbetween, for further facilitating cleaning of the leveling blade (3) and corresponding integrated casing (63) of the support bracket (5) after using the vibrating screed (1). Indeed, by having such an integrated casing (63), disposed about the leveling blade (3) in such a manner, substantially malleable material, such as concrete, and the like, with which the present vibrating screed (1) is intended to be used, is less likely to enter and/or interfere with components of the vibrating screed (1).

Another important aspect of the present invention resides in the fact that the vibration-generating assembly (21) comprises an electric motor (123) for imparting vibrations to the leveling blade (3) via the support bracket (5), the electric motor (123) being operatively mountable onto the support bracket (5), but being powered by a power supply (125) located separate from the vibrating screed (1). Indeed, the power supply (125) is a preferably portable power supply (125) removably mountable onto a user of the vibrating screed (1). As can be easily understood by a person skilled in the art when referring to FIGS. 12, 14 and 22, and according to a preferred aspect of the present invention, the portable power supply (125) is a rechargeable battery (127) storable inside a backpack (129) or a working belt (131) to be used by an operator of the vibrating screed (1), the rechargeable battery (127) being provided with electric wiring (133*a*) selectively and operatively connectable to corresponding electric wiring (133*b*) of the vibrating screed (1) via a corresponding connection (135) for powering the electric motor (123). This is particularly advantageous in that such a configuration allows for a much lighter vibrating screed (1), given the fact that the power supply (125) of the electric motor (123) is removed from said vibrating screed (1), and taken on by the user of the vibrating screed (1), and also has the advantage that the provision of electric motor (123) for the vibrating screed (1) enables to overcome all of the various drawbacks associated with gas-operated engines typically found in conventional vibrating screeds. This is a substantial improvement over the prior art, in that due to the provision of a portable power supply (125) separate from the vibrating screed (1), the vibrating screed (1) according to the present invention is a much lighter device, for improved and easier manoeuvrability, given that the power supply (125) and corresponding weight associated thereto are removed from the vibrating screed (1), and also allows for an easier interchangeability of power supplies (125), whenever they are depleted, given that they are easily and conveniently connected via electric wiring (133*a*) to corresponding electric wiring (133*b*) of the vibrating screed (1) by means of an easy connection (135*a*,135*b*), such as a plug, for example. Furthermore, the provision of a portable power supply (125) which is separate from the vibrating screed (1) is also advantageous in that due to the fact that the vibrating screed (1) has, as a result thereof, less overall weight, then the efficiency of vibration transmission from the motor, is improved, and thus, for a given level of vibration transmission, a smaller motor could also be used, therefore allowing to have an even more lightweight vibrating screed (1), for same vibrating capabilities as those of the prior art.

As previously explained, the vibrating screed (1) comprises a control system (35) for controlling an extent of vibrations generated by the vibration-generating assembly (21), and an actuator (37) is operatively linked to the control system (35) for controlling the same. The actuator (37) may be provided adjacent to a handle (39) of at least one handle bar (27), and may simply consist of a corresponding throttling mechanism, if used with a gas-powered engine as the motor assembly (105) for the vibration-generating assembly (21), but alternatively, the actuator (37) may be provided on a control box (137) mounted onto at least one corresponding bar (27, 31) of the handling assembly (23), as exemplified in FIGS. 12, 15 and 22, the actuator (37) simply consisting of a corresponding knob so that the user may adjustably control the extent of vibrations generated by the vibration-generating assembly (21) by positioning the knob about a given location within a visual indicator of magnitude. Of course, and as can also be understood by a person skilled in the art, various other types of control systems (35), actuators (37) and interactions thereinbetween may be used for the present vibrating screed (1) according to the present invention, depending on the particular applications for which the vibrating screed (1) is intended for, and the desired end results.

As may now be better appreciated from the above-discussed, various improvements have been incorporated into the present leveling blade (3) and corresponding vibrating screed (1) in order to overcome several of the drawbacks associated with the prior art.

It is worth mentioning also that the vibrating screed (1), and the different components thereof, as exemplified hereinabove, are preferably made of suitable materials, such as metallic materials, composite materials, and the like, which are preferably rigid enough to withstand the loads to which the vibrating screed (1) may be subjected to, depending on the particular applications therefore, as apparent to a person skilled in the art. Preferably also, these materials are provided with suitable features, such as corrosion resistant properties, so as to enable the vibrating screed (1) and the different components thereof to be subjected to water conditions and the like, so as to enable a proper cleaning thereof after operation with a malleable material, such as concrete and the like.

According to another aspect of the present invention, there is also provided a kit comprising different components for assembling a vibrating screed according to the present invention, such as the ones briefly described herein and such as the ones exemplified in the accompanying drawings.

As may now also be better appreciated, the present invention is also a substantial improvement over the prior art in that, by virtue of its design and components, the vibrating screed (1) is very simple and easy to use, as well as is very simple and easy to manufacture and/or assemble, without compromising the reliability of its functions. Hence, it may now be appreciated that the present invention represents important advantages over other related vibrating screed devices known in the prior art, in terms of performance, manoeuvrability, weight, ergonomics, transportation, and costs, as explained hereinabove.

Of course, numerous modifications could be made to the above-described embodiments without departing from the scope of the invention, as defined in the appended claims.

The invention claimed is:

1. A vibrating screed for leveling a surface of a substantially malleable material, the vibrating screed comprising:

a substantially L-shaped support bracket having a substantially horizontal portion and a substantially vertical portion;

a substantially L-shaped leveling blade comprising:

a leveling portion and a connecting portion, the connecting portion of the leveling blade being removably mountable onto the substantially vertical portion of the support bracket;

a substantially vertical portion for removably mounting onto the support bracket of the vibrating screed, said substantially vertical portion having front and rear sides, and first and second ends;

a substantially slanted portion extending rearwardly from the second end of the substantially vertical portion, said substantially slanted portion having inner and outer sides, and first and second ends;

a substantially horizontal portion extending frontwardly from the second end of the substantially slanted portion, said substantially horizontal portion having top and bottom sides, and first and second ends;

wherein the outer side of the substantially slanted portion is at an angle of about 160 degrees with respect to the rear side of the substantially vertical portion;

wherein the ratio between the length of the rear side of the substantially vertical portion of the leveling blade and the length of the bottom side of its substantially horizontal portion is about 0.4, wherein the ratio between the length of the rear side of the substantially vertical portion of the leveling blade and the length of the outer side of its substantially slanted portion is about 1.26, and wherein the top side of the substantially horizontal portion of the leveling blade tapers off frontwardly with respect to the bottom side thereof at an angle of about 2 degrees; and wherein transitions between adjacent portions of the leveling blade and the second end of the substantially horizontal portion thereof are substantially rounded off;

a vibration-generating assembly, the vibration-generating assembly being operatively mountable onto the support bracket for imparting vibrations to the leveling blade via the support bracket; and a handling assembly operatively connectable to the support bracket for handling the vibrating screed, the handling assembly comprising a pair of handle bars, each handle bar having a lower end provided with a corresponding connecting plate being operatively connectable to the support bracket by at least one fastener, each connecting plate being further operatively connectable to the support bracket by at least one vibration-damping joint made out of an elastomeric material for minimizing impartation of vibrations from the support bracket to the handling assembly;

wherein each handle bar comprises first and second sections being operatively connectable to one another; wherein the first sections of the handle bars each comprise a straight section and an inwardly-slanted section; and wherein the handling assembly comprises first and second cross-bars, the first cross-bar being a substantially straight cross-bar extending between the straight sections of the first sections of the handle bars, and the second cross-bar being a substantially arched cross-bar extending between the inwardly-slanted sections;

wherein each handle bar comprises a third section operatively connected to the second section thereof, the third section including a handle and being selectively adjustable in angle with respect to the second section along a substantially vertical plane via a tilt-adjustment assembly, the tilt-adjustment assembly comprising:

a sleeve provided transversally with respect to the second section of each handle bar, at a distal end thereof, the sleeve being provided with a given slit defining a range of possible angle configuration for the handle;

a pivot barrel removably insertable into the sleeve and having a threaded socket, the pivot barrel being rotatable inside the sleeve so that the threaded socket is displaceable along the given slit of the sleeve; and a screw component projecting from the handle and being threadably insertable into the threaded socket of the pivot barrel via rotation of the handle along a given rotation direction, the screw component being provided with a shouldering flange configured for being forced against the sleeve of the distal end of the handle bar when the screw component has reached a given distance inside the threaded socket so as to maintain the handle pressed at a given selected angle with respect to the sleeve within the range of possible angle configuration provided by the slit;

wherein the tilt-adjustment assembly further comprises a locking washer having a front face cooperable with the sleeve and an opposite rear face cooperable with the shouldering flange, an inner bore being defined between said opposite front and rear faces for allowing the screw component to pass therethrough, the front face of the locking washer having a concave configuration complementary to the outer shape of the sleeve so that tightening of the shouldering flange against the sleeve via the locking washer further aids in maintaining the handle secured against the sleeve at the given selected angle.

2. A vibrating screed according to claim 1, wherein the vibration-generating assembly comprises a motor assembly cooperating with a shaft assembly, the shaft assembly being drivable by the motor assembly and having an extremity provided with an eccentric cam so as to impart vibrations when rotatably driven by the motor assembly; and wherein the shaft assembly comprises a flexible engine shaft, the flexible engine shaft comprising:

a first end operatively connectable to the motor assembly;

a second end operatively connectable to the eccentric cam; and an interconnecting portion for interconnecting the first end to the second end;

the first and second ends of the flexible engine shaft being substantially rigid, whereas the intermediate portion being substantially flexible, and the eccentric cam being operatively drivable by the motor assembly via the engine flexible shaft.

3. A vibrating screed according to claim 1, wherein the vibration-generating assembly comprises an electric motor for imparting vibrations to the leveling blade via the support bracket, the electric motor being operatively mountable onto the support bracket, but being powered by a power supply located separate from the vibrating screed.

4. A vibrating screed according to claim 3, wherein the power supply is a portable power supply removably mountable onto a user of the vibrating screed.

5. A vibrating screed according to claim 4, wherein the portable power supply is a rechargeable battery storable inside a backpack or a working belt to be used by an operator of the vibrating screed, the rechargeable battery being provided with electric wiring selectively and operatively connectable to corresponding electric wiring of the vibrating screed via a corresponding connection for powering the electric motor.

6. A vibrating screed according to claim 5, wherein the vibrating screed comprises a control system for controlling an extent of vibrations generated by the vibration-generating assembly, and wherein an actuator is operatively linked to the control system for controlling the same.

* * * * *